US010342395B2

(12) United States Patent
Kobs et al.

(10) Patent No.: US 10,342,395 B2
(45) Date of Patent: Jul. 9, 2019

(54) SHEET PRODUCT DISPENSER WITH PRODUCT LEVEL GAUGE SYSTEM

(71) Applicant: GPCP IP Holdings LLC, Atlanta, GA (US)

(72) Inventors: Stephen Russel Kobs, Greenville, WI (US); Ryan Anthony Goltz, Neenah, WI (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 275 days.

(21) Appl. No.: 15/247,019

(22) Filed: Aug. 25, 2016

(65) Prior Publication Data

US 2017/0057775 A1 Mar. 2, 2017

Related U.S. Application Data

(60) Provisional application No. 62/211,351, filed on Aug. 28, 2015.

(51) Int. Cl.

| | |
|---|---|
| ***A47K 10/32*** | (2006.01) |
| ***A47K 10/36*** | (2006.01) |
| ***A47K 10/38*** | (2006.01) |

(52) U.S. Cl.

CPC ..... *A47K 10/38* (2013.01); *A47K 10/3625* (2013.01); *A47K 10/3687* (2013.01); *A47K 2010/326* (2013.01); *A47K 2010/3253* (2013.01)

(58) Field of Classification Search

CPC ..... A47K 10/3687; A47K 2010/3253; A47K 2010/3226

See application file for complete search history.

(56) References Cited

U.S. PATENT DOCUMENTS 2,601,956 A 7/1952 Birr
3,288,387 A 11/1966 Craven, Jr.
(Continued)

FOREIGN PATENT DOCUMENTS

GB 1 296 335 11/1972
GB 1296335 A 11/1972
(Continued)

OTHER PUBLICATIONS

Georgia-Pacific—Catalog Home—Paper Towels & Dispensers—GP enMotion® Splash Blue Impulse® 8 Automated Towel Dispenser Description; website Visited Aug. 22, 2016 ; 2pgs. http://catalog.gppro.com/catalog/6357/11795?filter_FULL.
(Continued)

*Primary Examiner* — William E Dondero
(74) *Attorney, Agent, or Firm* — Nelson Mullins Riley & Scarborough LLP

(57) ABSTRACT

An example sheet product dispenser includes a housing, a first roll holder, and a second roll holder. A first roll of sheet product is positioned on the first roll holder and assigned as a primary roll and a second roll of sheet product is positioned on the second roll holder and assigned as a secondary roll. A dispensing mechanism is configured to dispense sheet product from at least one of the first roll and the second roll. A sensor is configured to sense measurement data associated with the primary roll, including sensing when the primary roll rotates to dispense and measuring the diameter of the primary roll. A data communication device is in communication with the sensor and configured to transmit the measurement data. A controller is configured to determine situational information regarding the sheet product dispenser and provide corresponding alerts to users regarding the situational information and measured data.

22 Claims, 24 Drawing Sheets

(56) References Cited

U.S. PATENT DOCUMENTS

| | | | |
|---|---|---|---|
| 5,244,161 | A | 9/1993 | Wirtz-Odenthal |
| 5,294,192 | A | 3/1994 | Omdoll et al. |
| 5,441,189 | A | 8/1995 | Formon et al. |
| 5,772,291 | A | 6/1998 | Byrd et al. |
| 6,354,533 | B1 | 3/2002 | Jespersen |
| 6,360,181 | B1 | 3/2002 | Gemmell et al. |
| 6,411,920 | B1 | 6/2002 | McConnell et al. |
| 6,685,074 | B2 | 2/2004 | Gracyalny et al. |
| 6,766,977 | B2 | 7/2004 | Denen et al. |
| 6,826,991 | B1 | 12/2004 | Rasmussen |
| 6,830,210 | B2 | 12/2004 | Formon et al. |
| 6,908,059 | B2 | 6/2005 | Budz et al. |
| 7,040,566 | B1 | 5/2006 | Rodrian et al. |
| 7,270,292 | B2 | 9/2007 | Rasmussen |
| 7,370,824 | B1 | 5/2008 | Osborne |
| 7,507,045 | B1 | 3/2009 | Harris et al. |
| 7,523,885 | B2 | 4/2009 | Lewis |
| 7,648,098 | B2 | 1/2010 | Goeking et al. |
| 7,726,599 | B2 | 6/2010 | Lewis et al. |
| 7,774,096 | B2 | 8/2010 | Goerg et al. |
| 7,783,380 | B2 | 8/2010 | York et al. |
| 7,793,882 | B2 | 9/2010 | Reinsel et al. |
| 7,814,582 | B2 | 10/2010 | Reddy et al. |
| 7,984,872 | B2 | 7/2011 | Kuehneman et al. |
| 7,996,108 | B2 | 8/2011 | Yardley |
| 8,160,742 | B2 | 4/2012 | Goerg et al. |
| 8,511,599 | B2 | 8/2013 | Lalau et al. |
| 8,600,547 | B2 | 12/2013 | Petersen et al. |
| 8,616,489 | B2 | 12/2013 | Goeking et al. |
| 8,800,415 | B2 | 8/2014 | Osborne |
| 8,807,475 | B2 | 9/2014 | Rodrian et al. |
| 9,067,754 | B2 | 6/2015 | Petersen et al. |
| 2007/0194166 | A1 | 8/2007 | Reinsel et al. |
| 2008/0099595 | A1 | 5/2008 | Lewis |
| 2008/0245922 | A1 | 10/2008 | Fellhoelter |
| 2013/0079923 | A1 | 3/2013 | Cittadino et al. |
| 2013/0240554 | A1 | 9/2013 | Stråhlin et al. |
| 2014/0067113 | A1 | 3/2014 | Petersen et al. |
| 2014/0367401 | A1 | 12/2014 | Strålin et al. |
| 2015/0066207 | A1 | 3/2015 | Erb |
| 2015/0097068 | A1 | 4/2015 | Larson et al. |
| 2015/0238056 | A1 | 8/2015 | Fellhoelter |
| 2015/0313420 | A1 | 11/2015 | Tramontina et al. |
| 2016/0187484 | A1 | 6/2016 | Bloomfield et al. |
| 2017/0042390 | A1 | 2/2017 | Rubenson et al. |

FOREIGN PATENT DOCUMENTS

| | | |
|---|---|---|
| SE | 364178 | 2/1974 |
| WO | WO 2005/065509 A1 | 7/2005 |
| WO | WO 2007/068884 | 6/2007 |
| WO | WO 2017/105464 A1 | 12/2015 |

OTHER PUBLICATIONS

Georgia-Pacific—Catalog Home—Paper Towels & Dispensers—GP enMotion® Splash Blue Impulse® 10 Automated Towel Dispenser Description; website visited Aug. 22, 2016; 2pgs. http://catalog.gppro.com/catalog/6387/12519?filter_FULL.

YouTube Video—Georgia-Pacific enMotion® Impulse 10 Automated Towel Dispenser Support; website visited Aug. 22, 2016; 1 pg. https://www.youtube.com/watch?v=8Cyypt-xGs0&list-PLF88677BE73FE88B5&index=1.

International Search Report and Written Opinion for PCT/US2016/048826, dated Nov. 4, 2016.

SHEET PRODUCT DISPENSER WITH PRODUCT LEVEL GAUGE SYSTEM

CROSS-REFERENCE TO RELATED APPLICATION(S)

This application claims priority to U.S. Provisional Patent Application No. 62/211,351, filed Aug. 28, 2015, entitled "Sheet Product Dispenser with Product Level Gauge System", which is hereby incorporated by reference in its entirety.

FIELD

Embodiments of the present invention relate to sheet product dispensers and, more particularly, to a system for monitoring the fuel gauge of sheet product in dispensers.

BACKGROUND

Sheet product dispensers, such as paper towel dispensers or tissue dispensers, provide on-demand sheet product to a user from a supply of sheet product stored within the dispenser, such as in roll form. The sheet product is dispensed from the roll by passing one end of the sheet product through a pair of rollers. Depending on the type of dispenser, dispensing may be accomplished automatically (e.g., with a motor) or manually (e.g., using the force a user applies). As the user pulls the sheet product, cutting arrangements (or perforations) may be used to separate a portion for use (e.g., a dispensed portion).

Some dispensers have a single roll of sheet product usable for dispensing. Others have multiple rolls, one or more being stored for use once the first roll is depleted. In either type of dispenser, it is desirable to avoid an empty condition where no sheet product is dispensed.

SUMMARY OF THE INVENTION

In light of the foregoing background, embodiments of the present invention provide one or more sensors that measure data associated with one or more rolls of sheet product (e.g., paper towel, tissue, etc.) stored in the dispenser. Example sensors monitor the fuel gauge (e.g., product level gauge, the amount of product remaining, etc.) of a roll of sheet product. Additionally, the sensor may be configured to monitor when the roll of sheet product is rotating to dispense sheet product therefrom. This measurement data can be used to determine situational information about the sheet product dispenser (e.g., the amount of product remaining, if a proper reassignment of the roll of sheet product has occurred, which roll of sheet product (in a multi-roll dispenser) is actively dispensing, if double sheeting is occurring, among others). The measurement data or other information (such as associated alerts) can be sent to remote devices or displayed to provide an enhanced user experience and aid in inventory management.

An example embodiment of the present invention provides a sheet product dispenser comprising a housing, a first roll holder, and a second roll holder. The first roll holder is positioned within the housing and configured to hold a first roll of sheet product, wherein the first roll of sheet product is assigned as a primary roll. The second roll holder is positioned within the housing and configured to hold a second roll of sheet product, wherein the second roll of sheet product is assigned as a secondary roll. The sheet product dispenser further comprises a dispensing mechanism positioned within the housing and configured to dispense a portion of sheet product from at least one of the first roll and the second roll. The sheet product dispenser further comprises a sensor positioned within the housing.

In some embodiments, the sensor is configured to sense measurement data associated with at least one of the primary roll or the secondary roll. The sensor is configured to sense when the one of the primary roll or the secondary roll rotates to dispense the portion of sheet product. The sensor is further configured to measure the diameter of the one of the primary roll or the secondary roll.

In some embodiments, the sensor is configured to contact an outer surface of one of the primary roll or the secondary roll. The sensor is configured to sense measurement data associated with the one of the primary roll or the secondary roll. The sensor is configured to measure at least one of angular displacement of the sensor around a pivot axis connecting the sensor to the housing or linear displacement of a first portion of the sensor with respect to a second portion of the sensor to enable determination of an amount of sheet product remaining on at least the one of the primary roll or the secondary roll.

In some embodiments, the one of the primary roll or the secondary roll defines an outer surface. The sensor is configured to contact the outer surface of the one of the primary roll or the secondary roll.

In some embodiments, the sensor comprises a paddle body defining a first end and a second end. The paddle body is pivotably attached to the housing proximate the first end around a pivot axis. The paddle body is configured to measure a diameter of the one of the primary roll or the secondary roll based on an angle of movement around the pivot axis. The sensor further comprises a roller positioned proximate the second end of the paddle body and configured to contact the outer surface of the one of the primary roll or the secondary roll. The roller is configured to sense when the one of the primary roll or the secondary roll rotates to dispense the portion of sheet product. Additionally, in some embodiments, the sensor comprises a battery. The battery and the data communication device are attached to the paddle body such that the sensor forms a single, self-powered unit that is configured to be utilized with a non-automated sheet product dispenser. Additionally, in some embodiments, the paddle body is flexible to maintain contact of the roller with the outer surface of the one of the primary roll or the secondary roll in an instance in which the one of the primary roll or the secondary roll defines a deformed shape.

In some embodiments, the sensor comprises at least one arm defining a first end and a second end. The first end of the at least one arm is attached to one of the housing or an axis of the primary roll or secondary roll. The at least one arm is configured to measure a diameter of the one of the primary roll or the secondary roll based on an amount of linear movement of the first end with respect to the second end. The sensor further comprises a roller positioned proximate the second end of the at least one arm and configured to contact the outer surface of the one of the primary roll or the secondary roll. The roller is configured to sense when the one of the primary roll or the secondary roll rotates to dispense the portion of sheet product.

In some embodiments, the data communication device is configured to transmit a signal that contains the measurement data indicating both when the one of the primary roll or the secondary roll rotates to dispense the portion of sheet product and an amount of sheet product remaining on the one of the primary roll or the secondary roll.

In some embodiments, the sheet product dispenser further comprises a controller in communication with a data communication device. The controller is configured to receive the measurement data and cause the data communication device to transmit the measurement data.

In some embodiments, the sheet product dispenser further comprises a controller in communication with the sensor. The sensor is configured to sense measurement data associated with the primary roll. Additionally, the controller may be configured to determine the amount of sheet product remaining on the secondary roll based on, at least, the received measurement data corresponding to the primary roll. Additionally or alternatively, in an instance in which another roll of sheet product is positioned within the housing and assigned to be the primary roll, the controller may be configured to determine if the first roll of sheet product was reassigned to become the secondary roll by determining an instance in which both sheet product is being dispensed and the primary roll is not rotating. Additionally or alternatively, the controller may be configured to determine whether the primary roll or the secondary roll is actively dispensing. Additionally or alternatively, the controller may be configured to determine an instance in which both the primary roll and the secondary roll are actively dispensing by determining an instance in which the first roll of sheet product was reassigned to become the secondary roll and determining an instance in which the primary roll of sheet product is actively dispensing and the amount of sheet product remaining on the secondary roll is greater than zero.

In some embodiments, the controller may be configured to determine an alert to provide to a user, wherein the alert is associated with at least one of: an amount of sheet product remaining on the primary roll; an amount of sheet product remaining on the secondary roll; a condition of the primary roll indicating that the first roll of sheet product may be reassigned to become the secondary roll; whether the first roll of sheet product was successfully reassigned to become the secondary roll; whether the primary roll or the secondary roll is actively dispensing; or an instance in which both the primary roll and the secondary roll are actively dispensing.

In some embodiments, the controller may be configured to determine an alert to provide to a user, wherein the alert is determined in response to at least one of: determining if the first roll of sheet product was reassigned to become the secondary roll; or determining an instance in which both the primary roll and the secondary roll are actively dispensing.

In some embodiments, the controller may be further configured to control the dispensing mechanism to dispense the sheet product. Additionally, the controller may be configured to adjust a parameter of the dispensing mechanism based, at least, on the received measurement data.

In some embodiments, the sensor may be configured to apply a smoothing filter to received measurement data to account for a deformed shaped of the primary roll.

Another example embodiment provides a system for monitoring usage of sheet product. The system comprises a sheet product dispenser comprising a housing, a first roll holder, and a second roll holder. The first roll holder is positioned within the housing and configured to hold a first roll of sheet product, wherein the first roll of sheet product is assigned as a primary roll. The second roll holder is positioned within the housing and configured to hold a second roll of sheet product, wherein the second roll of sheet product is assigned as a secondary roll. The sheet product dispenser further comprises a dispensing mechanism positioned within the housing and configured to dispense a portion of sheet product from at least one of the first roll and the second roll. The system further comprises a sensor positioned within the housing and configured to sense measurement data associated with at least one of the primary roll or the secondary roll. The sensor is configured to sense when the one of the primary roll or the secondary roll rotates to dispense the portion of sheet product. The sensor is further configured to measure the diameter of the one of the primary roll or the secondary roll.

The example system may include additional or alternative embodiments as described herein, such as described above with respect to the first example sheet product dispenser.

Another example embodiment provides a method of assembling a sheet product dispenser. The method comprises providing a sheet product dispenser, the sheet product dispenser comprising a housing, a first roll holder, and a second roll holder. The first roll holder is positioned within the housing and configured to hold a first roll of sheet product, wherein the first roll of sheet product is assigned as a primary roll. The second roll holder is positioned within the housing and configured to hold a second roll of sheet product, wherein the second roll of sheet product is assigned as a secondary roll. The sheet product dispenser further includes a dispensing mechanism positioned within the housing and configured to dispense a portion of sheet product from at least one of the first roll and the second roll. The method further comprises attaching a sensor to the housing. The sensor is configured to sense measurement data associated with at least one of the primary roll or the secondary roll. The sensor is configured to sense when the one of the primary roll or the secondary roll rotates to dispense the portion of sheet product. The sensor is further configured to measure the diameter of the one of the primary roll or the secondary roll.

The example method may include additional or alternative embodiments as described herein, such as described above with respect to the first example sheet product dispenser.

Another example embodiment provides a sheet product dispenser comprising a housing and a roll holder. The roll holder is positioned within the housing and configured to hold a roll of sheet product, wherein the roll of sheet product defines an outer surface. The sheet product dispenser further includes a dispensing mechanism positioned within the housing and configured to dispense a portion of sheet product from the roll of sheet product. The sheet product dispenser further includes a sensor positioned within the housing and defining a first end and a second end. The sensor is pivotably attached to the housing proximate the first end around a pivot axis. The second end of the sensor is configured to contact the outer surface of the roll of sheet product. The sensor is configured to measure angular displacement of the sensor around the pivot axis to enable determination of an amount of sheet product remaining on the roll of sheet product.

In some embodiments, the sheet product dispenser further comprises a data communication device in communication with the sensor and configured to transmit measurement data associated with the measured angular displacement of the sensor.

In some embodiments, the sensor is configured to measure angular displacement of the second end of the sensor from prior to an instance of dispensing of the portion of the sheet product to after the instance of dispensing of the portion of the sheet product.

In some embodiments, the sensor is configured to pivot between at least a first position defined prior to an instance of dispensing of the portion of the sheet product and a second position defined after the instance of dispensing of the portion of the sheet product. The sensor is configured to measure the angular displacement of the sensor between the first position and the second position to enable determination of an amount of sheet product remaining on the roll of sheet product after the instance of dispensing of the portion of the sheet product.

In some embodiments, the sensor further comprises a roller positioned proximate the second end and configured to contact the outer surface of the roll of sheet product. The roller is configured to sense when the roll of sheet product rotates to dispense the portion of sheet product.

In some embodiments, the data communication device is configured to transmit a signal that contains the measurement data indicating both when the roll of sheet product rotates to dispense the portion of sheet product and the angular displacement of the sensor.

In some embodiments, the sensor comprises a battery. The battery and the data communication device are attached to the sensor such that the sensor forms a single, self-powered unit that is configured to be utilized with a non-automated sheet product dispenser.

In some embodiments, the sheet product dispenser is non-automated such that force from a user exerted on a leading edge of the portion of sheet product enables dispensing of the portion of sheet product through the dispensing mechanism.

In some embodiments, the sheet product dispenser further comprises a controller in communication with the sensor and the data communication device, wherein the controller is configured to receive the measurement data.

In some embodiments, the controller is configured to determine the amount of sheet product remaining on the roll of sheet product based on, at least, the received measurement data.

In some embodiments, the controller is configured to determine an alert to provide to a user associated with the determined amount of sheet product remaining on the roll of sheet product.

In some embodiments, the sheet product dispenser is automated such that the controller is further configured to control the dispensing mechanism to dispense the sheet product.

In some embodiments, the controller is configured to adjust a parameter of the dispensing mechanism based, at least, on the received measurement data.

Another example embodiment provides a system for monitoring usage of sheet product. The system comprises a sheet product dispenser comprising a housing and a roll holder positioned within the housing and configured to hold a roll of sheet product. The roll of sheet product defines an outer surface. The sheet product dispenser further includes a dispensing mechanism positioned within the housing and configured to dispense a portion of sheet product from the roll of sheet product. The system further includes a sensor positioned within the housing and defining a first end and a second end. The sensor is pivotably attached to the housing proximate the first end around a pivot axis. The second end of the sensor is configured to contact the outer surface of the roll of sheet product. The sensor is configured to measure angular displacement of the sensor around the pivot axis to enable determination of an amount of sheet product remaining on the roll of sheet product.

The example system may include additional or alternative embodiments as described herein, such as described above with respect to the second example sheet product dispenser.

Another example embodiment provides a method of assembling a sheet product dispenser. The method comprises providing a sheet product dispenser, the sheet product dispenser comprising a housing and a roll holder positioned within the housing and configured to hold a roll of sheet product. The roll of sheet product defines an outer surface. The sheet product dispenser further includes a dispensing mechanism positioned within the housing and configured to dispense a portion of sheet product from the roll of sheet product. The method further includes attaching a sensor to the housing. The sensor defines a first end and a second end. The sensor is pivotably attached to the housing proximate the first end around a pivot axis. The second end of the sensor is configured to contact the outer surface of the roll of sheet product. The sensor is configured to measure angular displacement of the sensor around the pivot axis to enable determination of an amount of sheet product remaining on the roll of sheet product.

The example method may include additional or alternative embodiments as described herein, such as described above with respect to the second example sheet product dispenser.

Another example embodiment of the present invention provides an apparatus for sensing measurement data associated with an amount of sheet product remaining on a roll of sheet product in a sheet product dispenser. The apparatus comprises a paddle body defining a first end and a second end. The apparatus is configured to be pivotably attached to a housing of the sheet product dispenser around a pivot axis proximate the first end. The second end of the apparatus is configured to contact an outer surface of the roll of sheet product disposed within the sheet product dispenser. The apparatus further includes a sensor configured to measure angular displacement of the second end around the pivot axis to enable determination of an amount of sheet product remaining on the roll of sheet product. The apparatus further includes a data communication device in communication with the sensor and configured to transmit measurement data associated with the measured angular displacement of the sensor.

In some embodiments, the apparatus further comprises a battery. The apparatus forms a single, self-powered unit that is configured to be utilized with a non-automated sheet product dispenser.

In some embodiments, the sensor is configured to measure angular displacement of the second end of the apparatus from prior to an instance of dispensing of a portion of the sheet product from the sheet product dispenser to after the instance of dispensing of the portion of the sheet product from the sheet product dispenser.

In some embodiments, the sensor is configured to pivot between at least a first position defined prior to an instance of dispensing of a portion of the sheet product from the sheet product dispenser and a second position defined prior to the instance of dispensing of the portion of the sheet product from the sheet product dispenser. The sensor is configured to measure the angular displacement of the second end of the apparatus between the first position and the second position to enable determination of an amount of sheet product remaining on the roll of sheet product after the instance of dispensing of the portion of the sheet product.

In some embodiments, the apparatus further comprises a roller positioned proximate the second end and configured to contact the outer surface of the roll of sheet product. The roller is configured to sense when the roll of sheet product rotates to dispense the portion of sheet product.

In some embodiments, the data communication device is configured to transmit a signal that contains the measurement data indicating both when the roll of sheet product rotates to dispense the portion of sheet product and the angular displacement of the second end of the apparatus.

In some embodiments, the apparatus further includes a controller in communication with the sensor and the data communication device.

Example systems and methods are also contemplated, and may include embodiments as described herein, such as described above with respect to the example apparatus.

BRIEF DESCRIPTION OF THE SEVERAL VIEWS OF THE DRAWINGS

Figure 1:
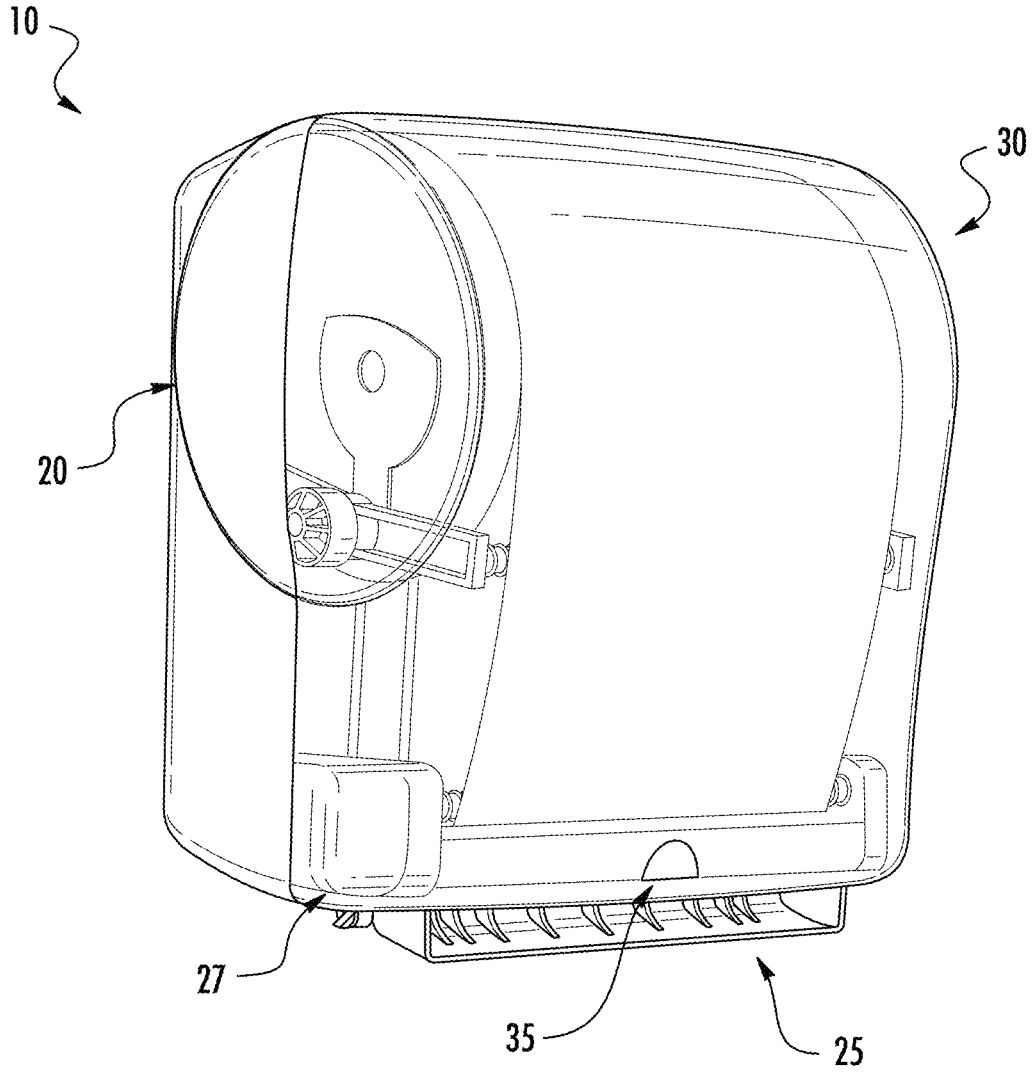
Figure 2:
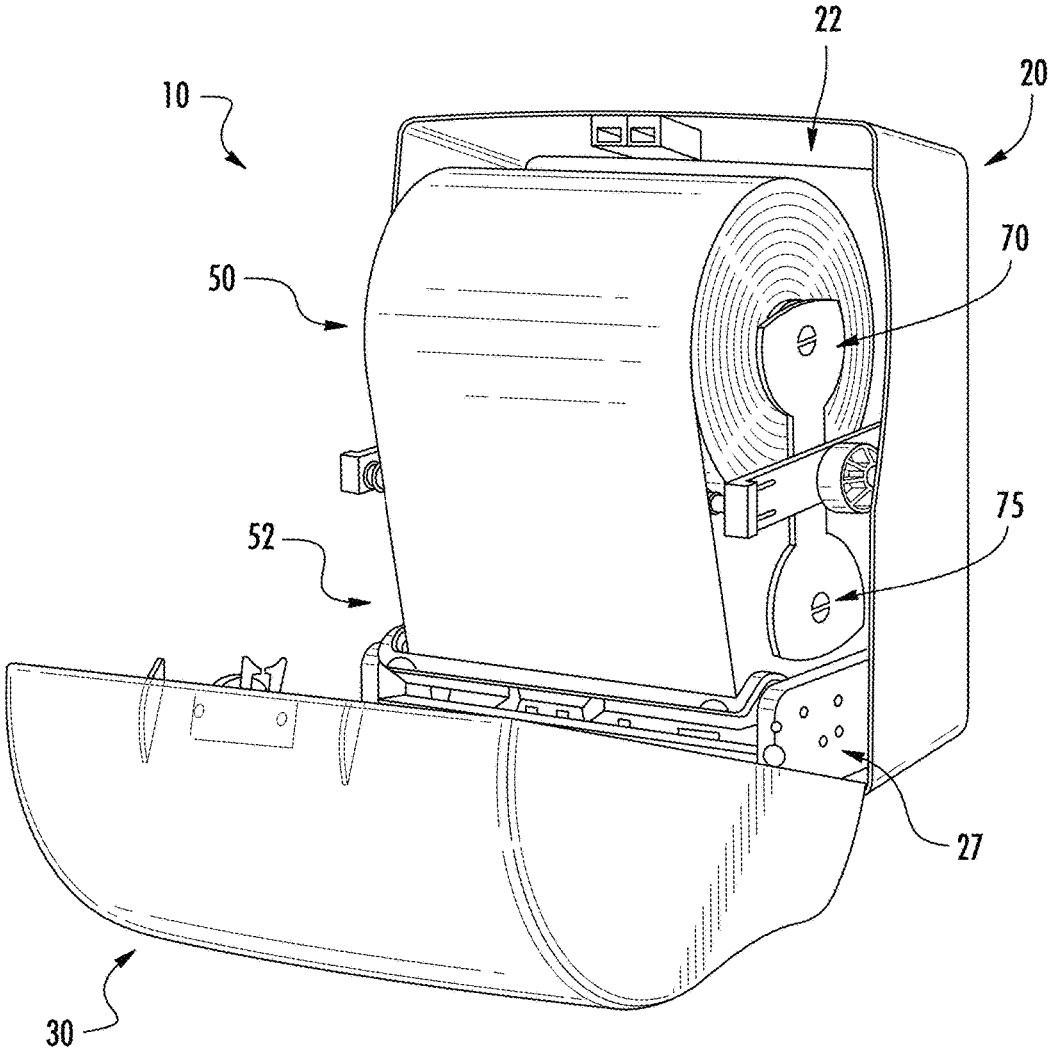
Figure 2A:
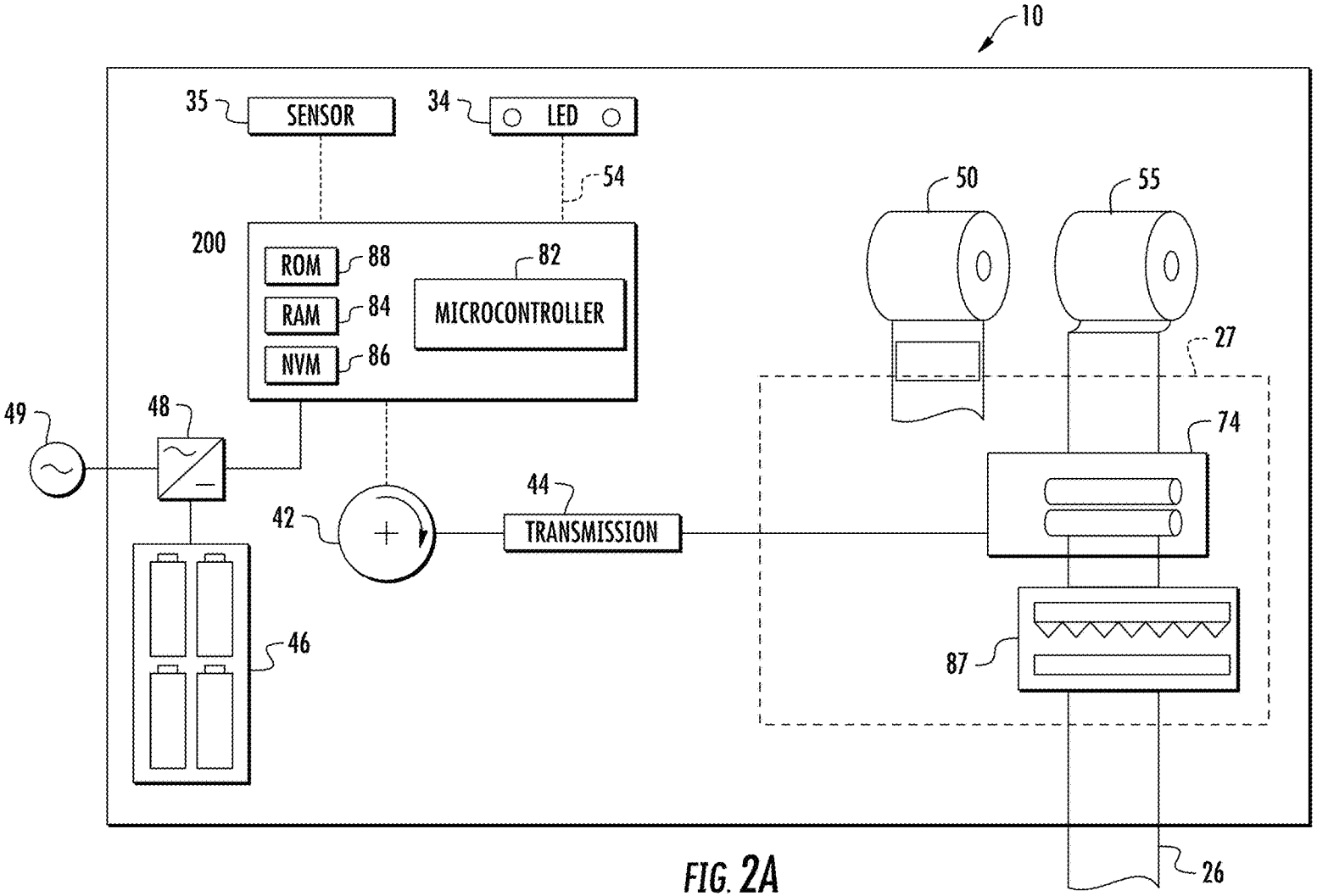
Figure 3:
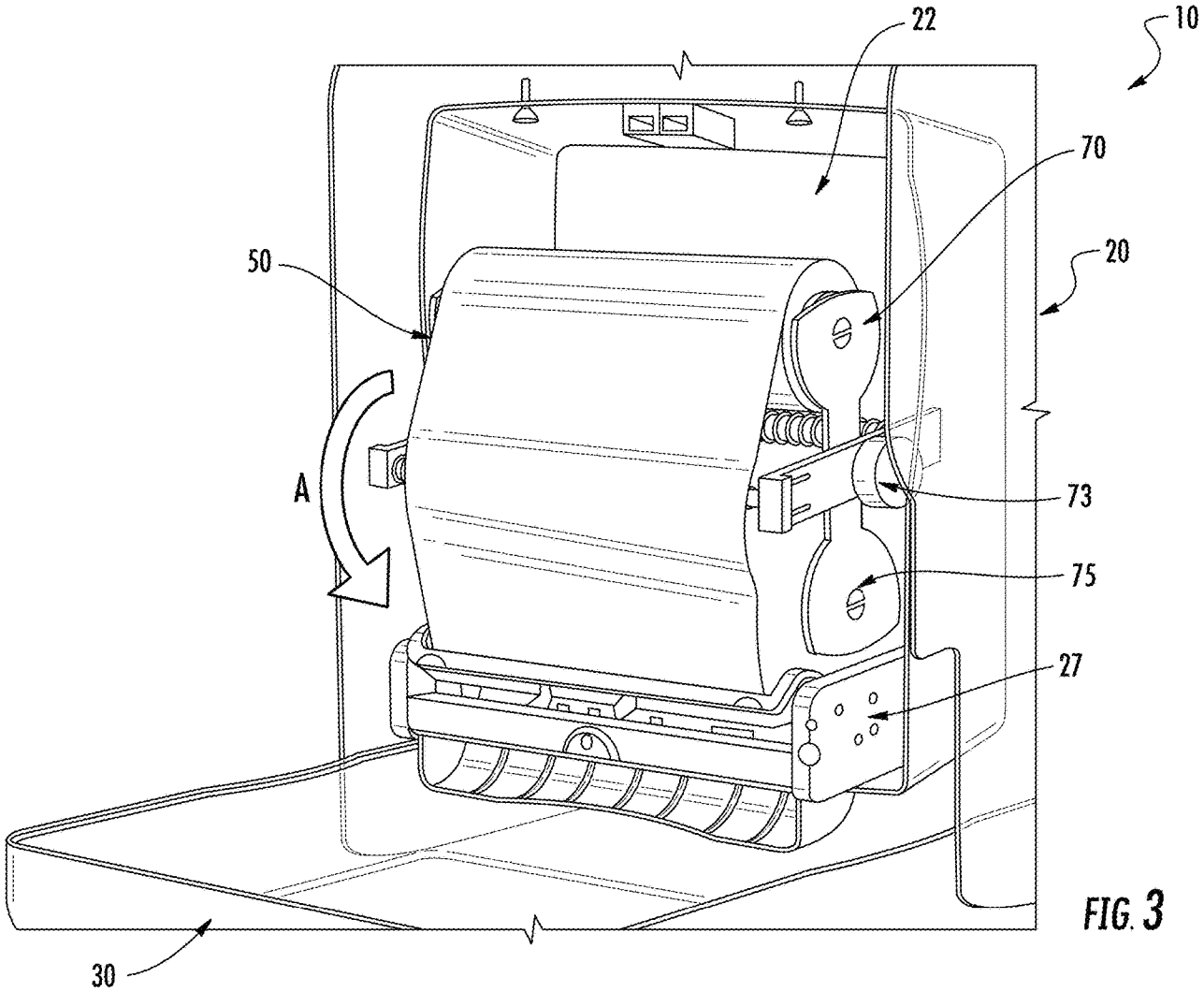
Figure 4:
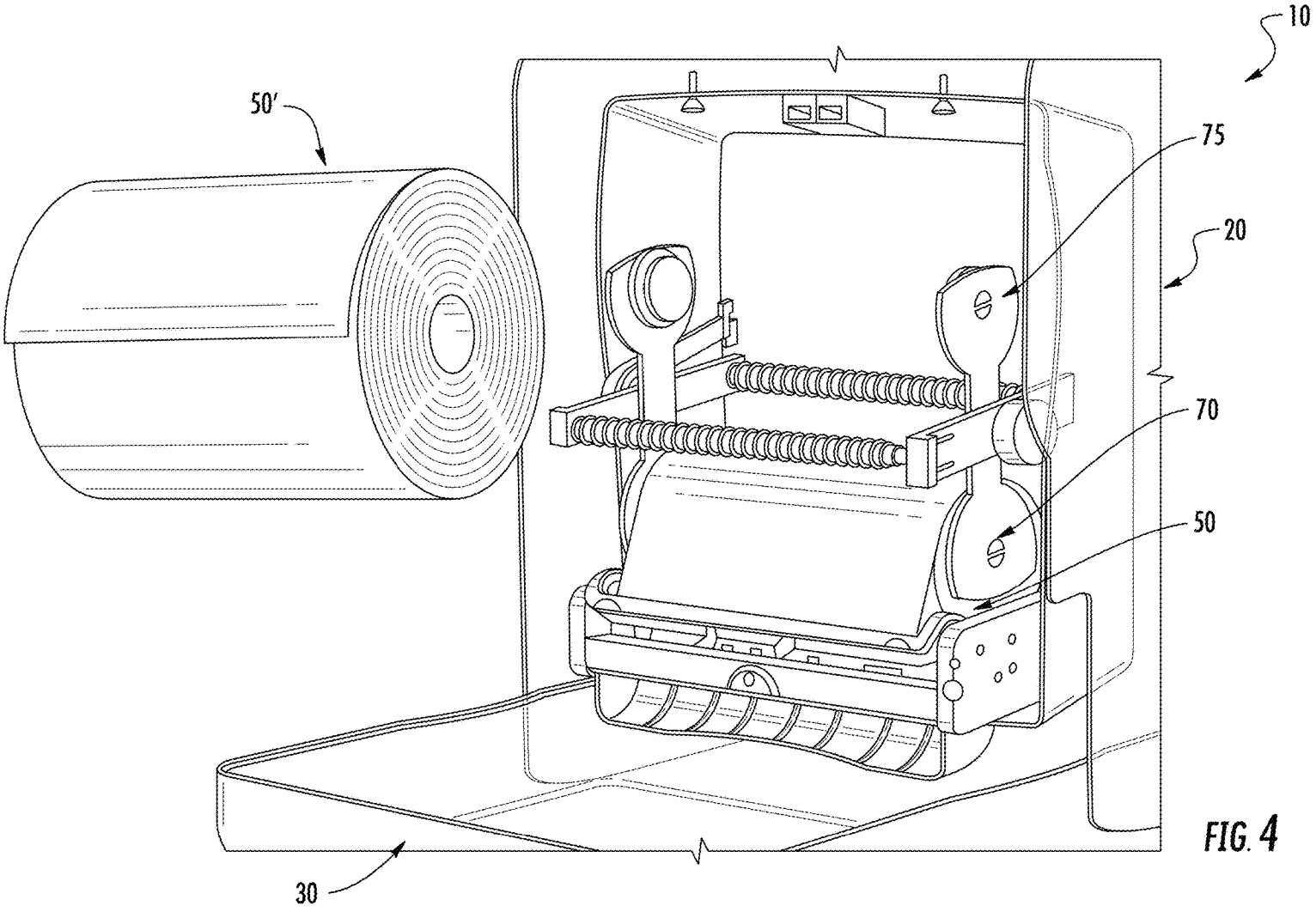
Figure 5:
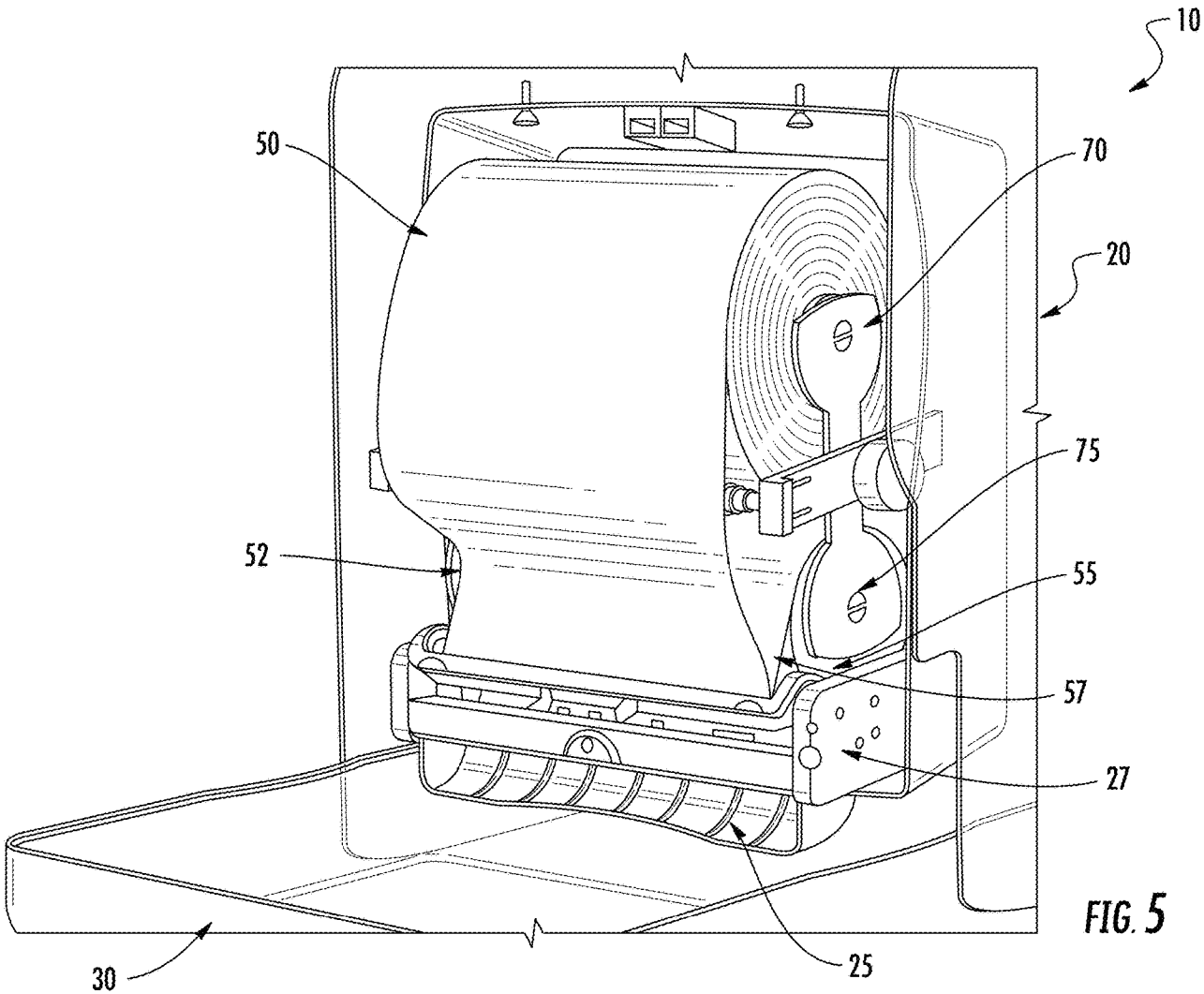
Figure 6A:
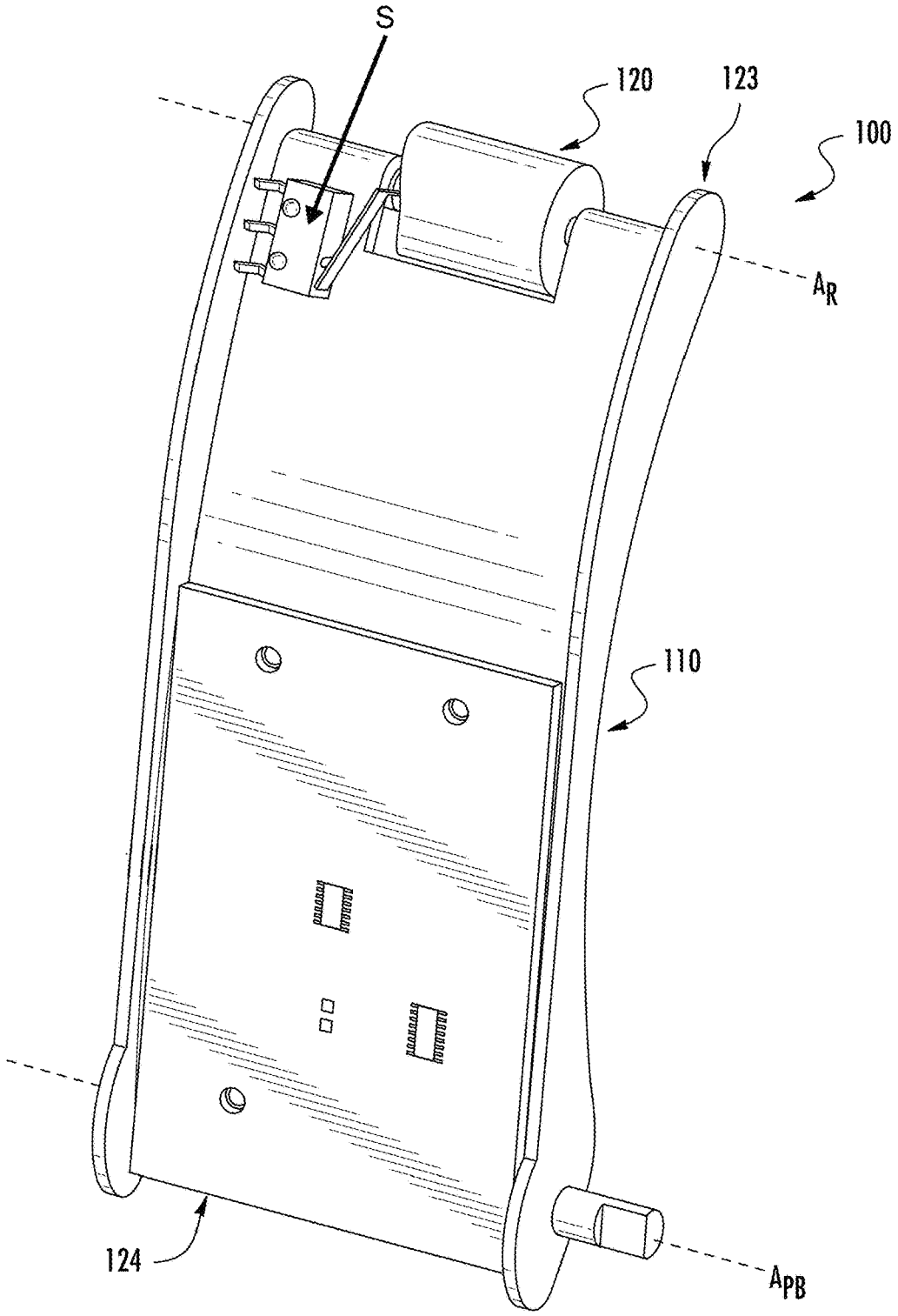
Figure 6B:
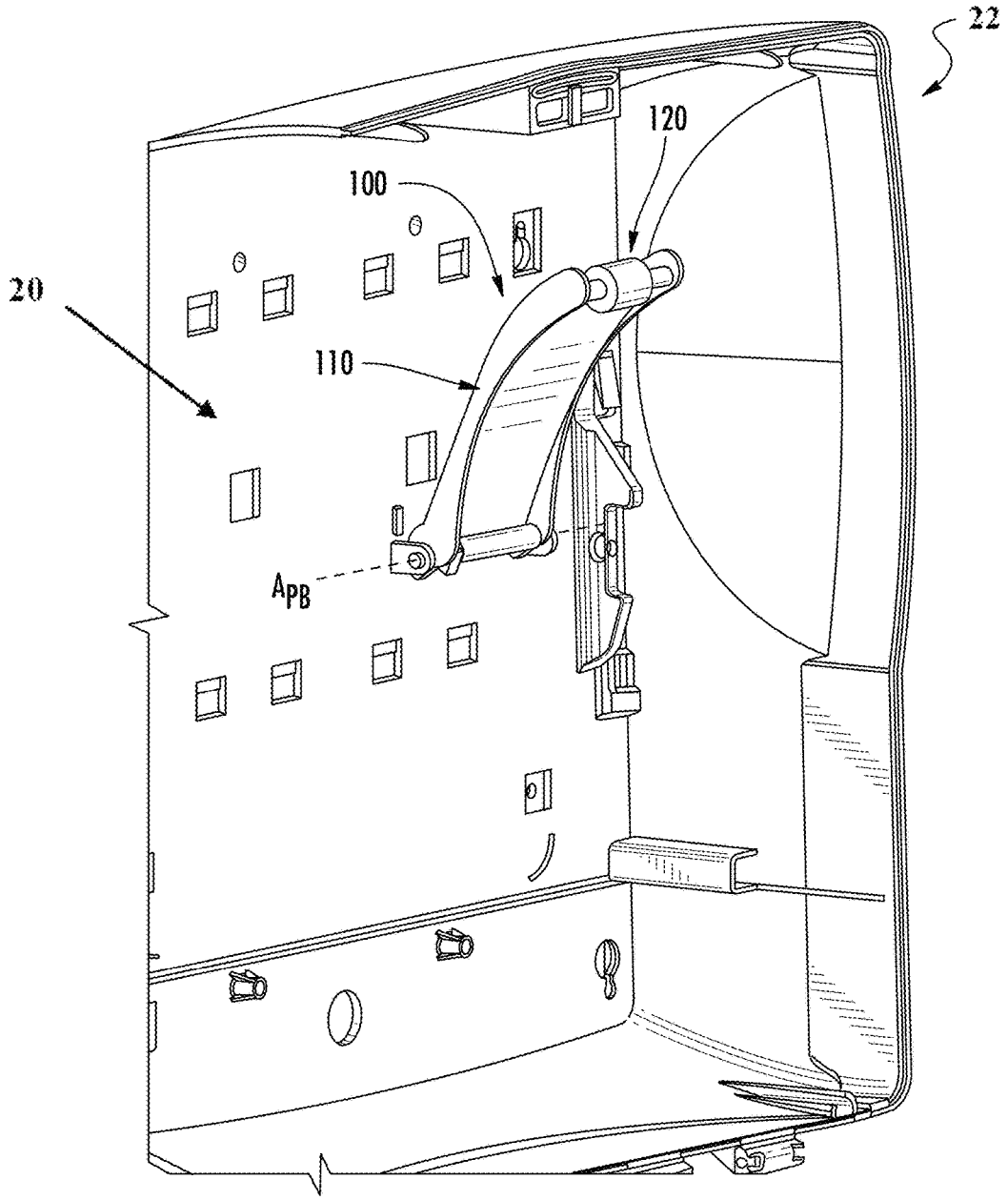
Figure 6C:
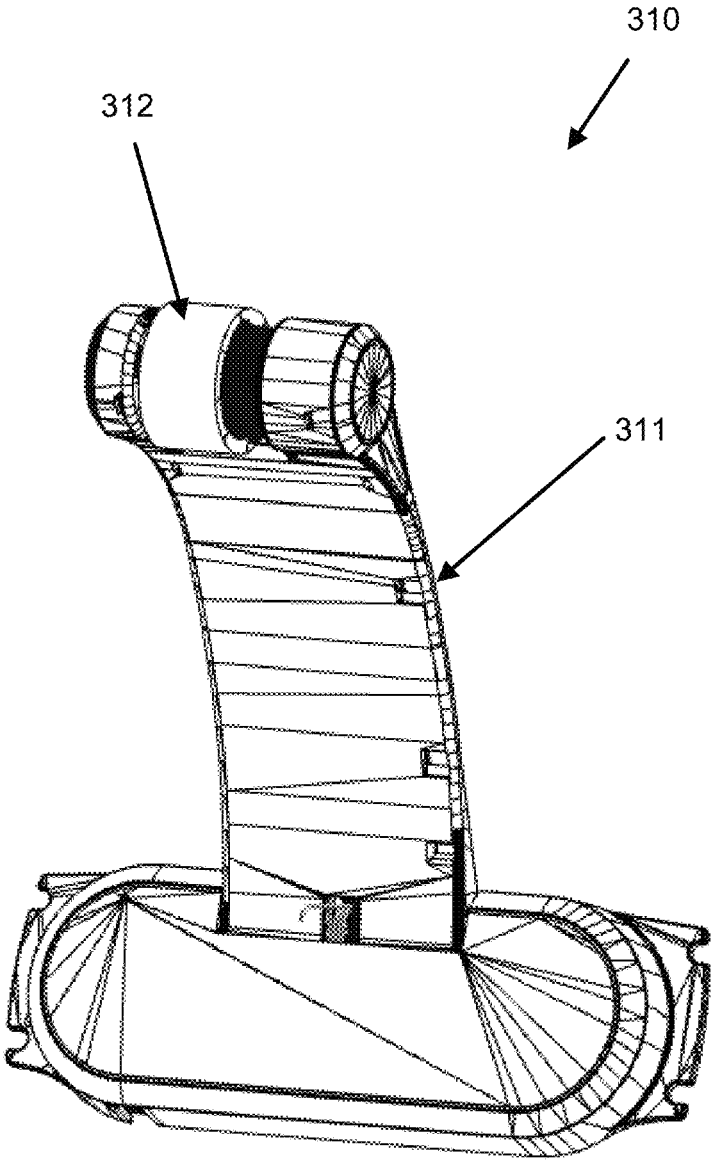
Figure 6D:
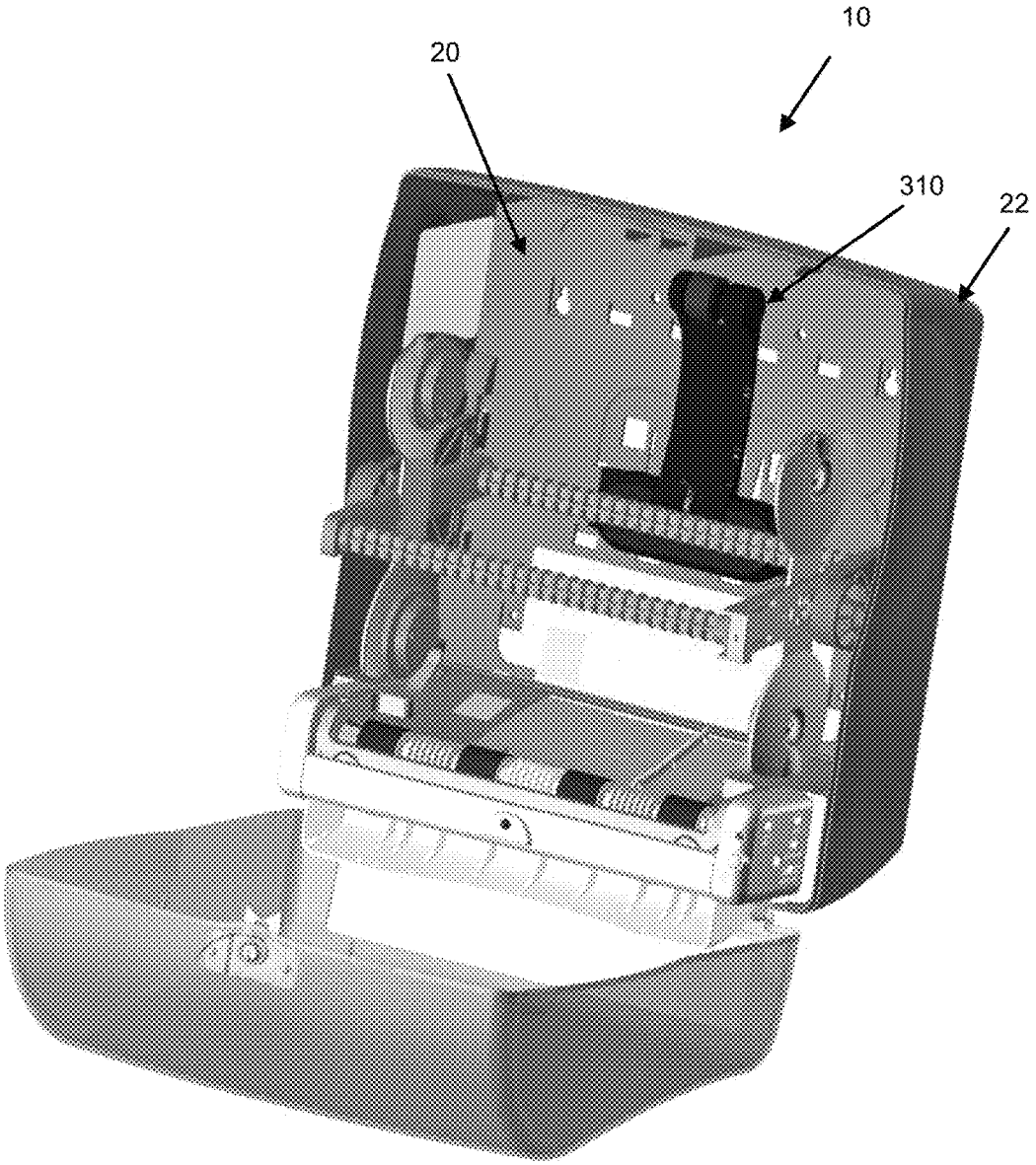
Figure 7A:
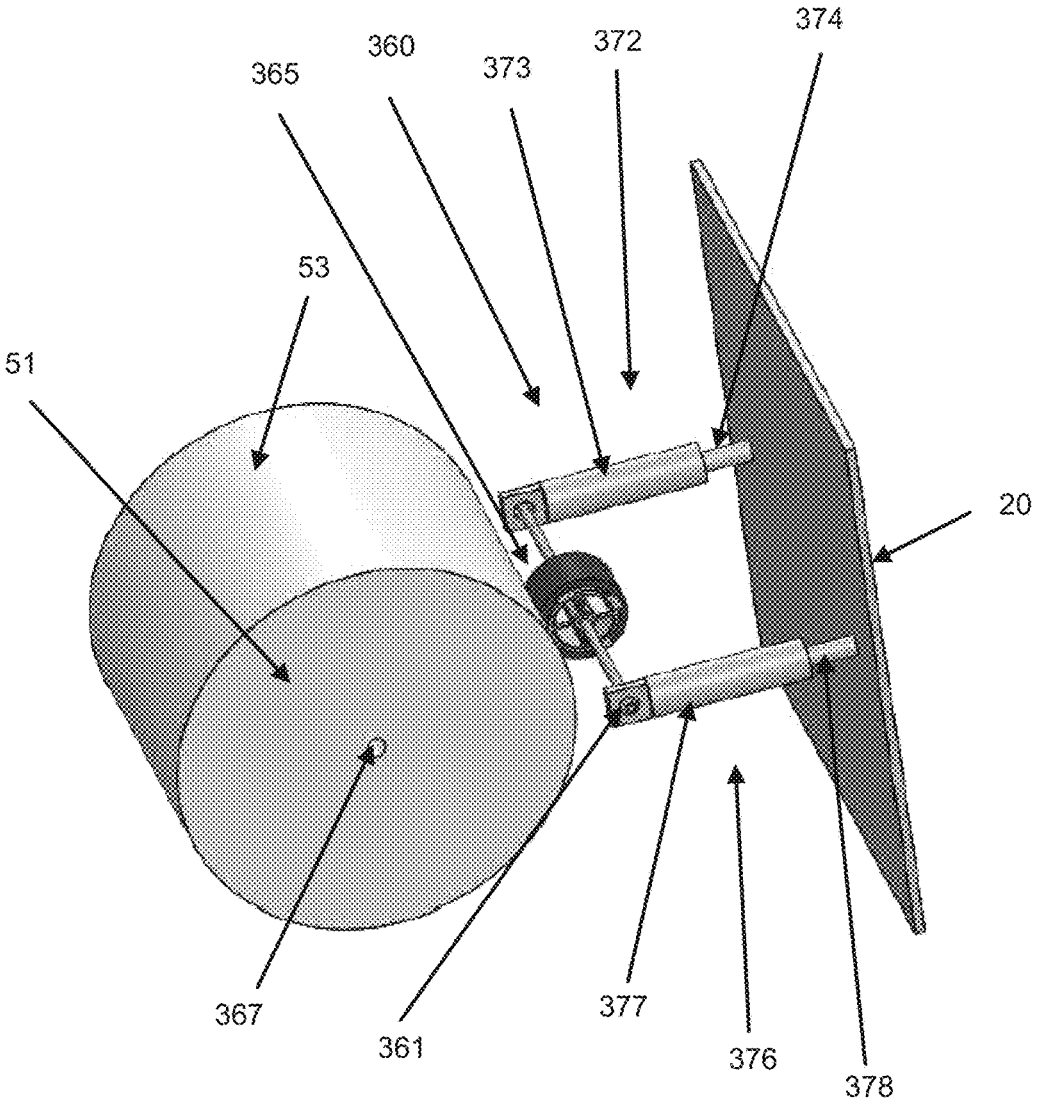
Figure 7B:
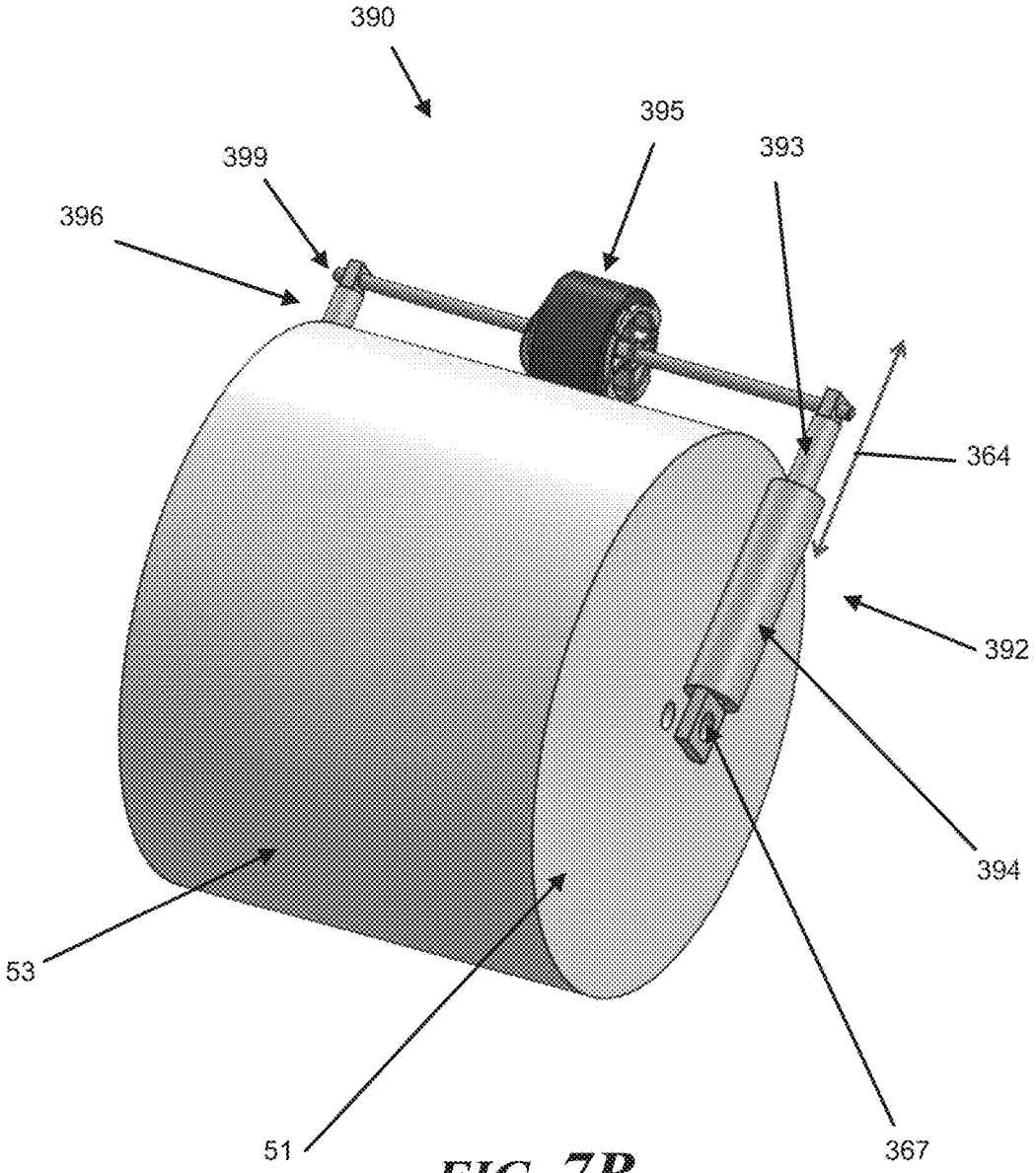
Figure 8A:
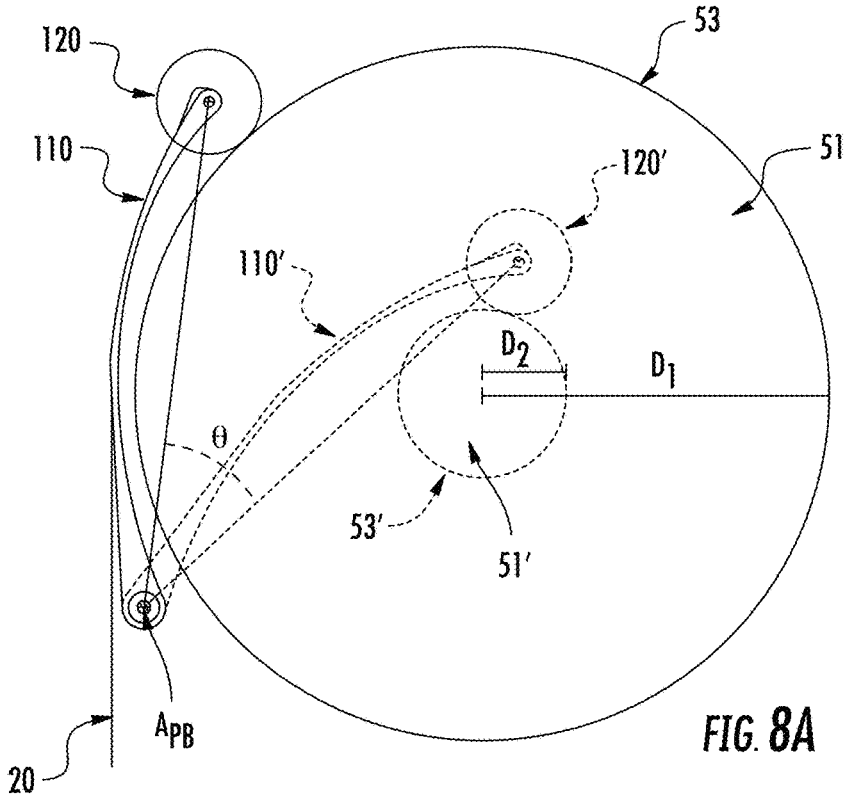
Figure 8B:
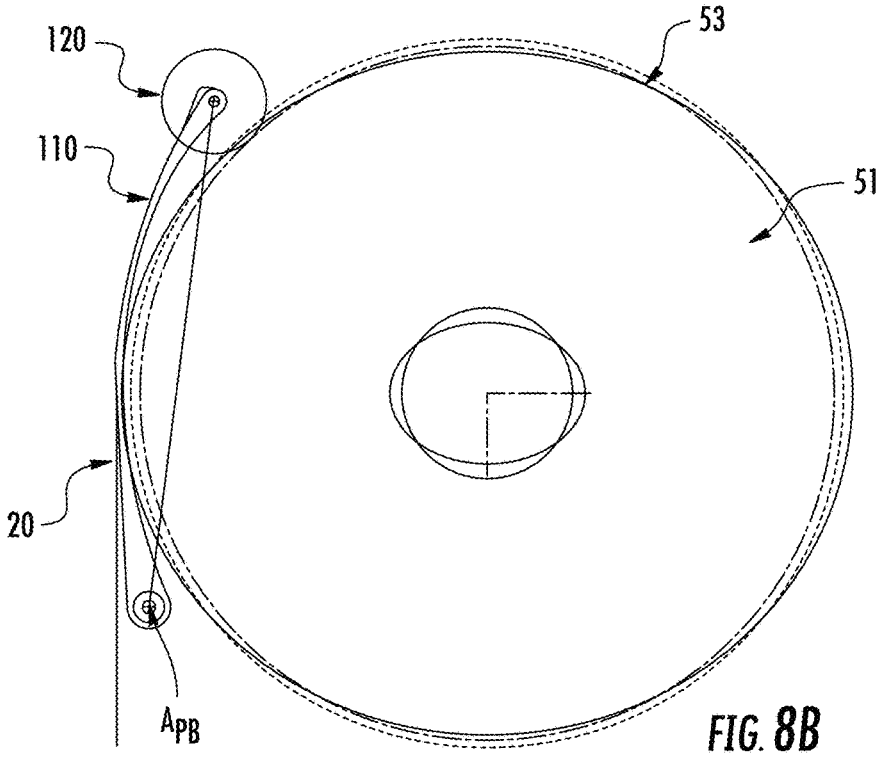
Figure 8C:
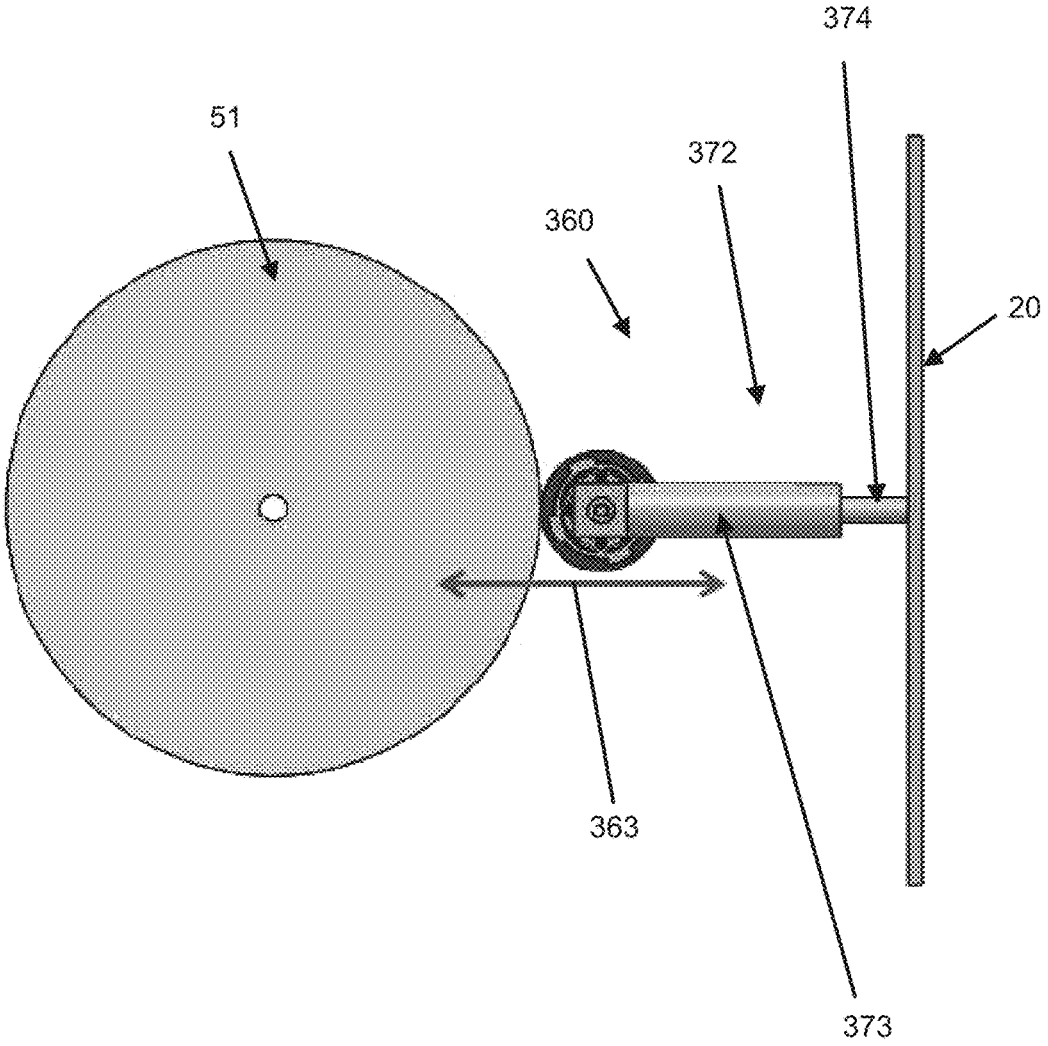
Figure 9A:
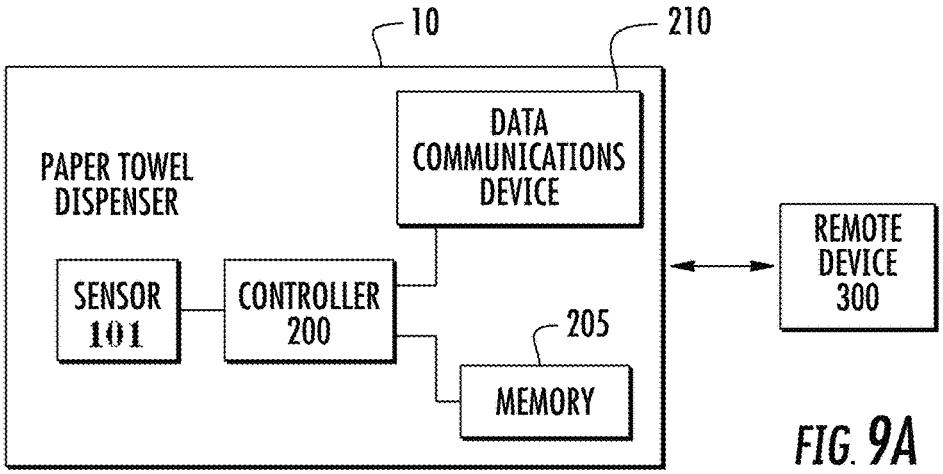
Figure 9B:
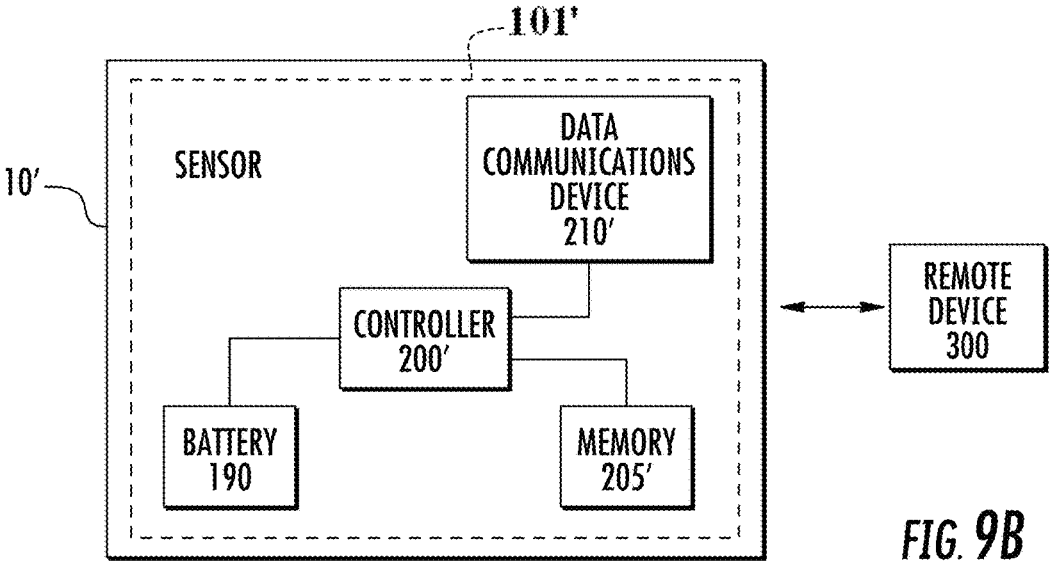
Figure 10A:
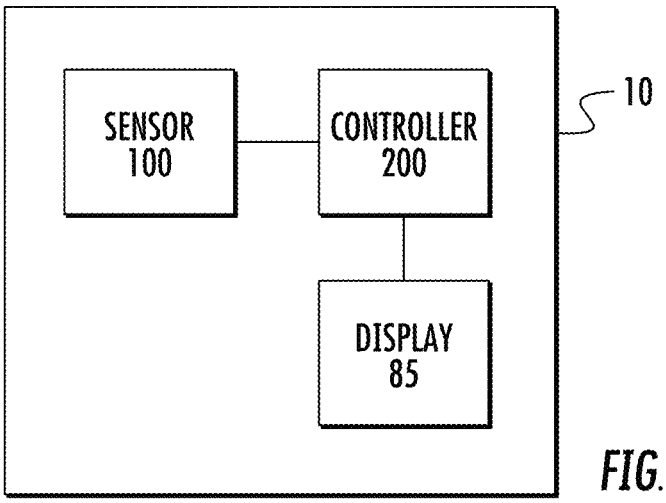
Figure 10B:
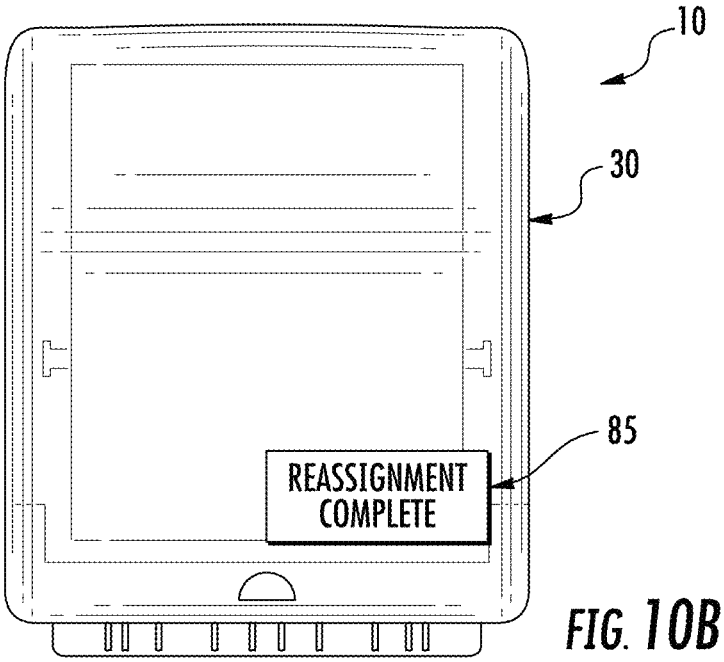
Figure 11:
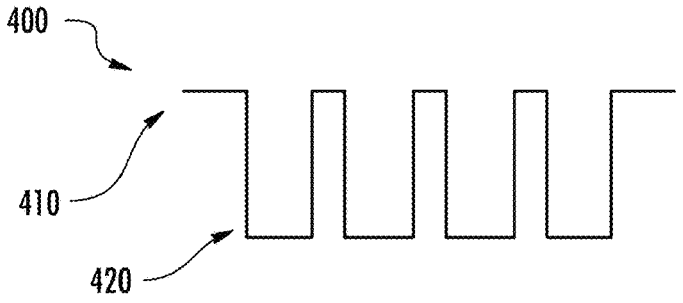
Figure 11A:
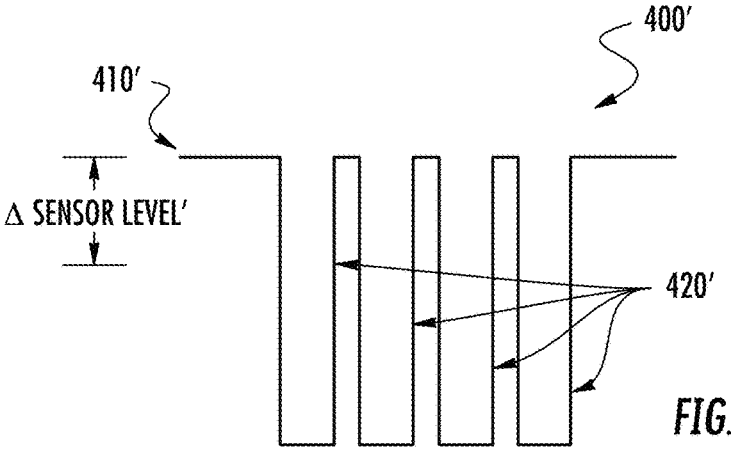
Figure 11B:
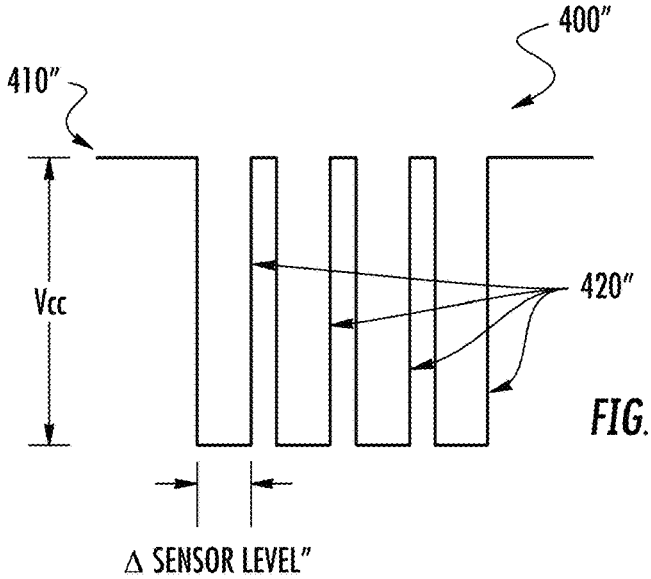
Figure 12:
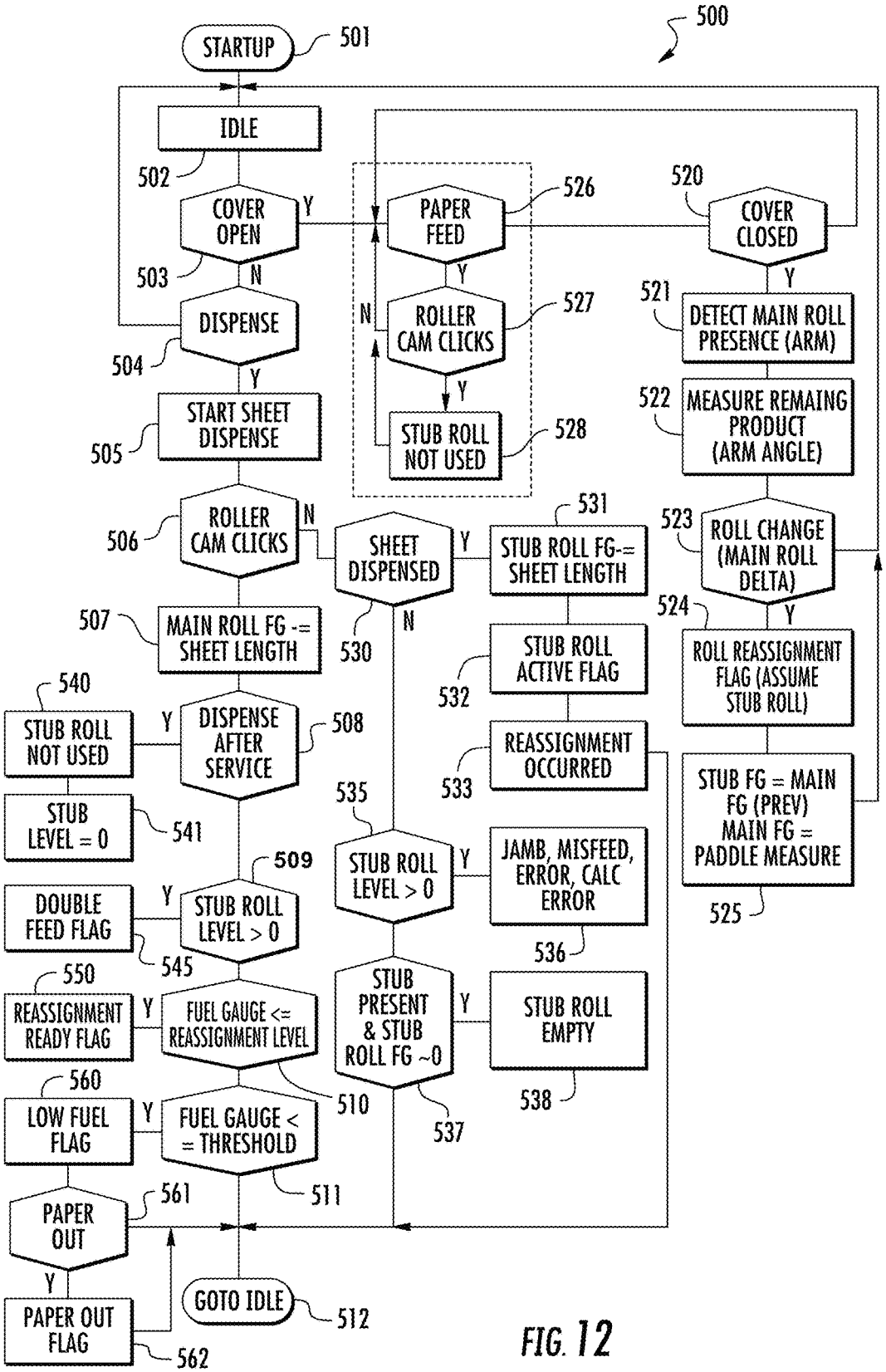
Figure 13:
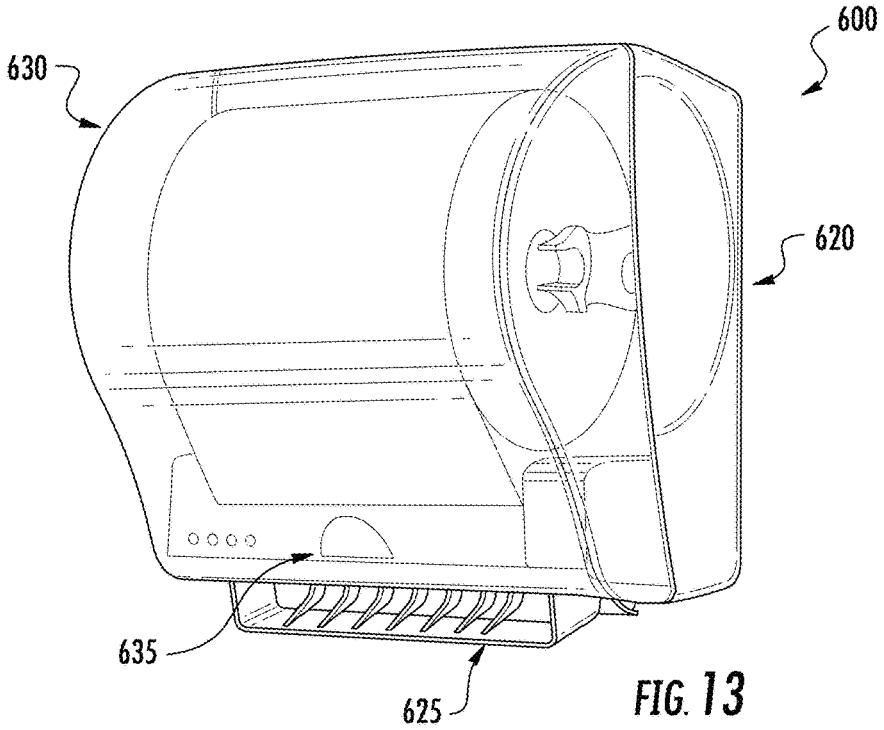
Figure 14:
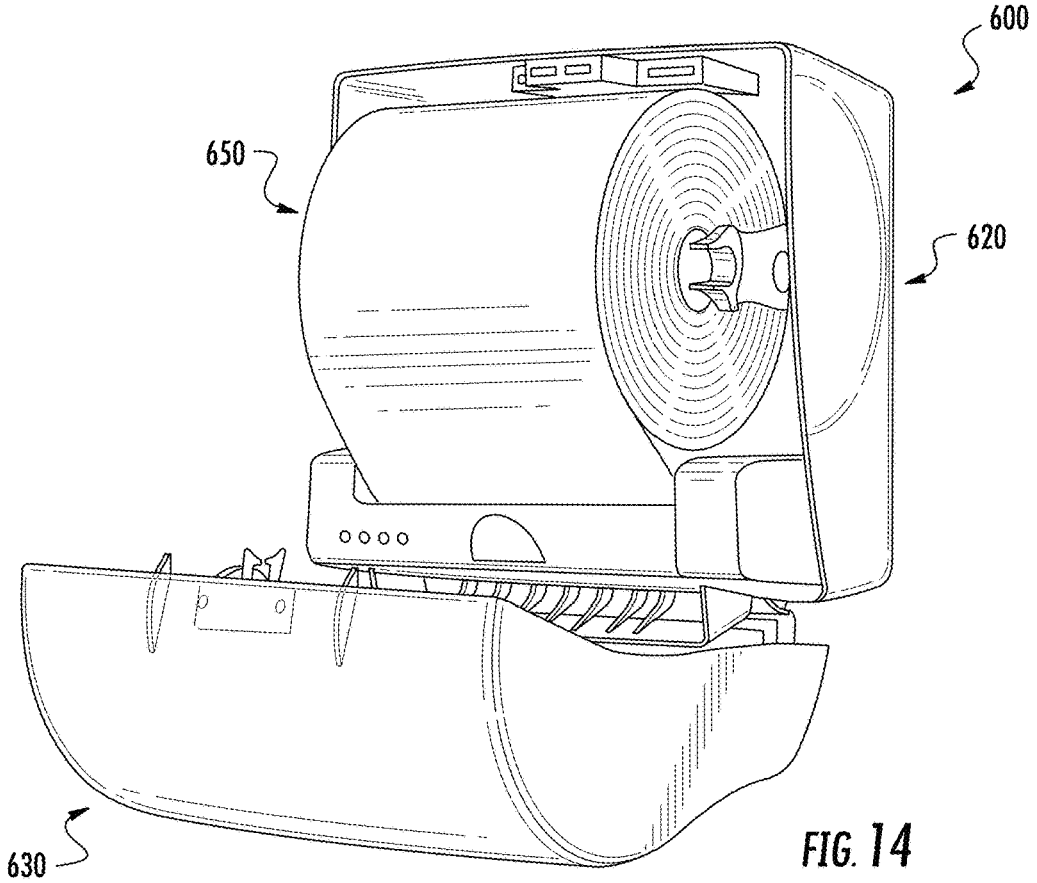
Figure 15:
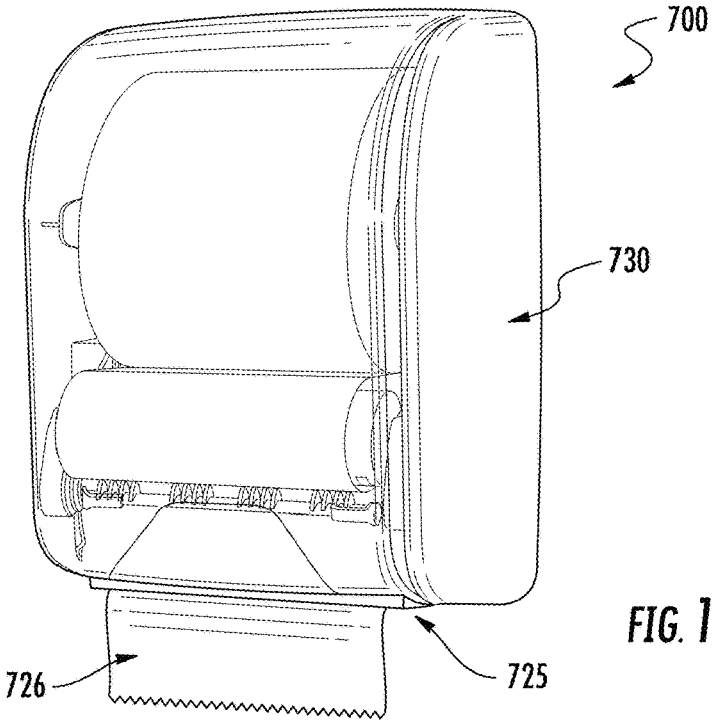
Figure 15A:
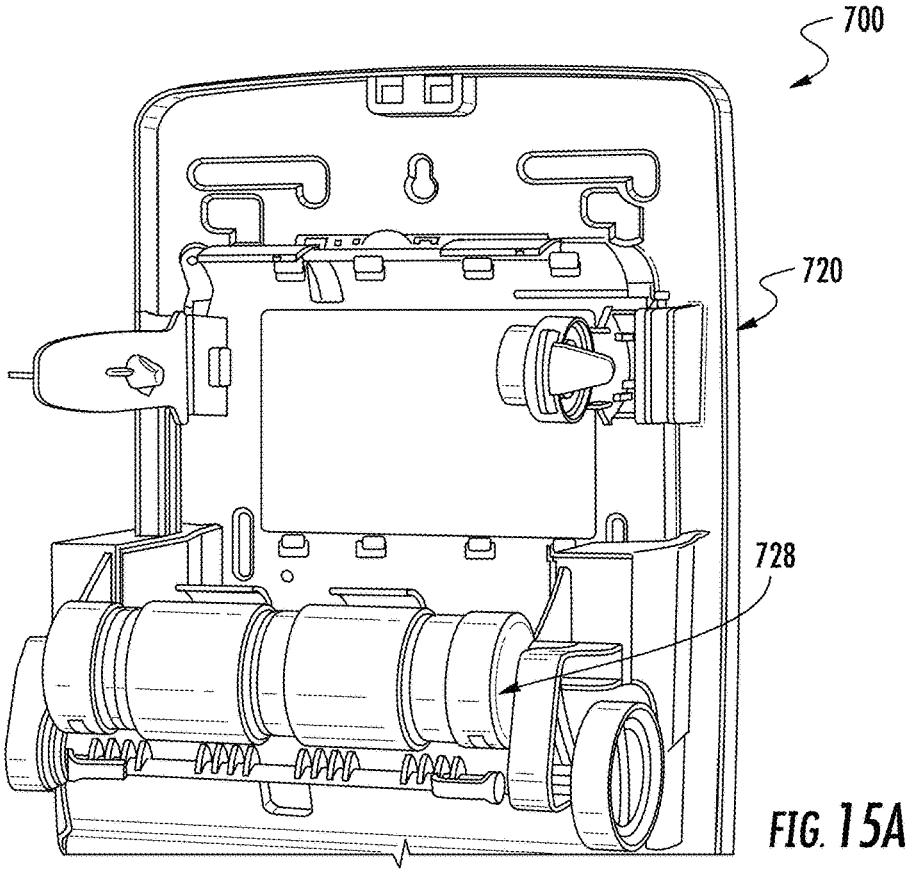
Figure 15B:
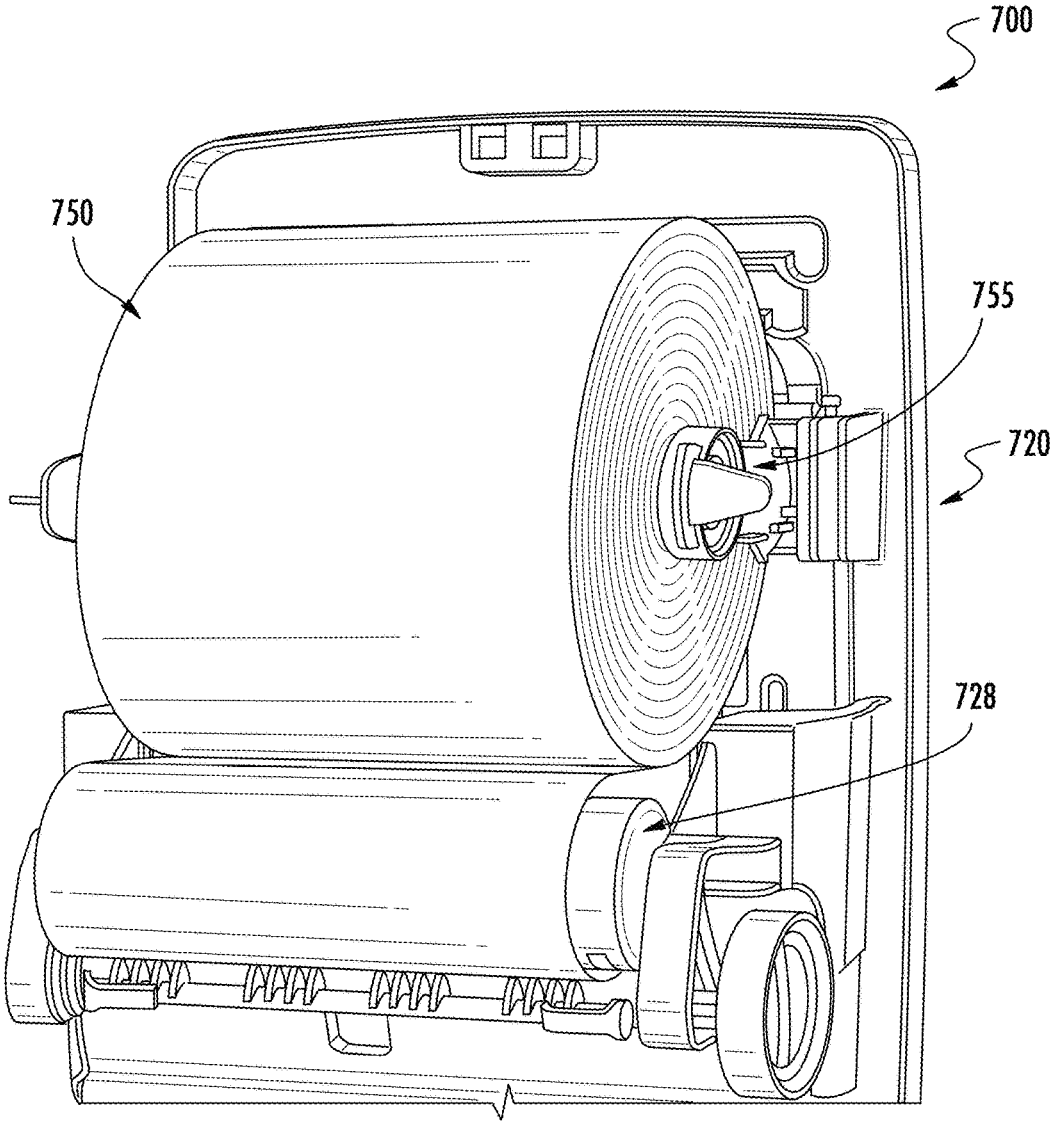
Figure 16:
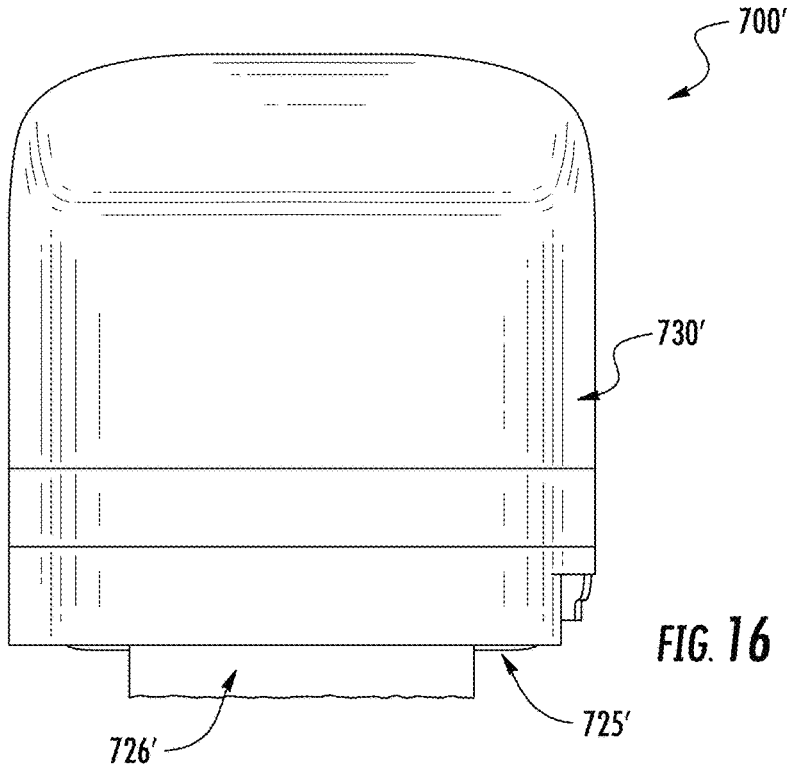
Figure 17:
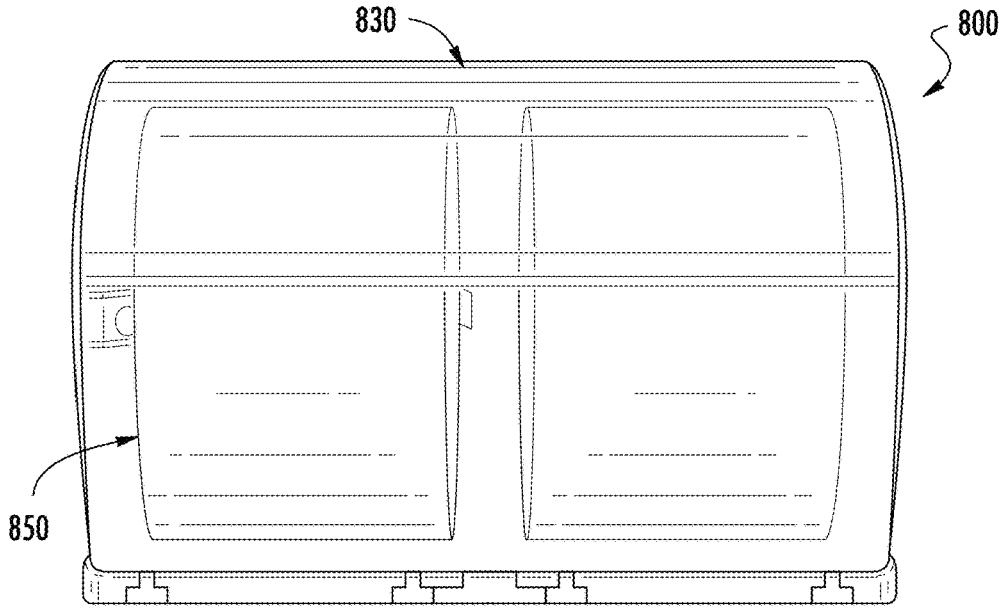
Figure 18A:
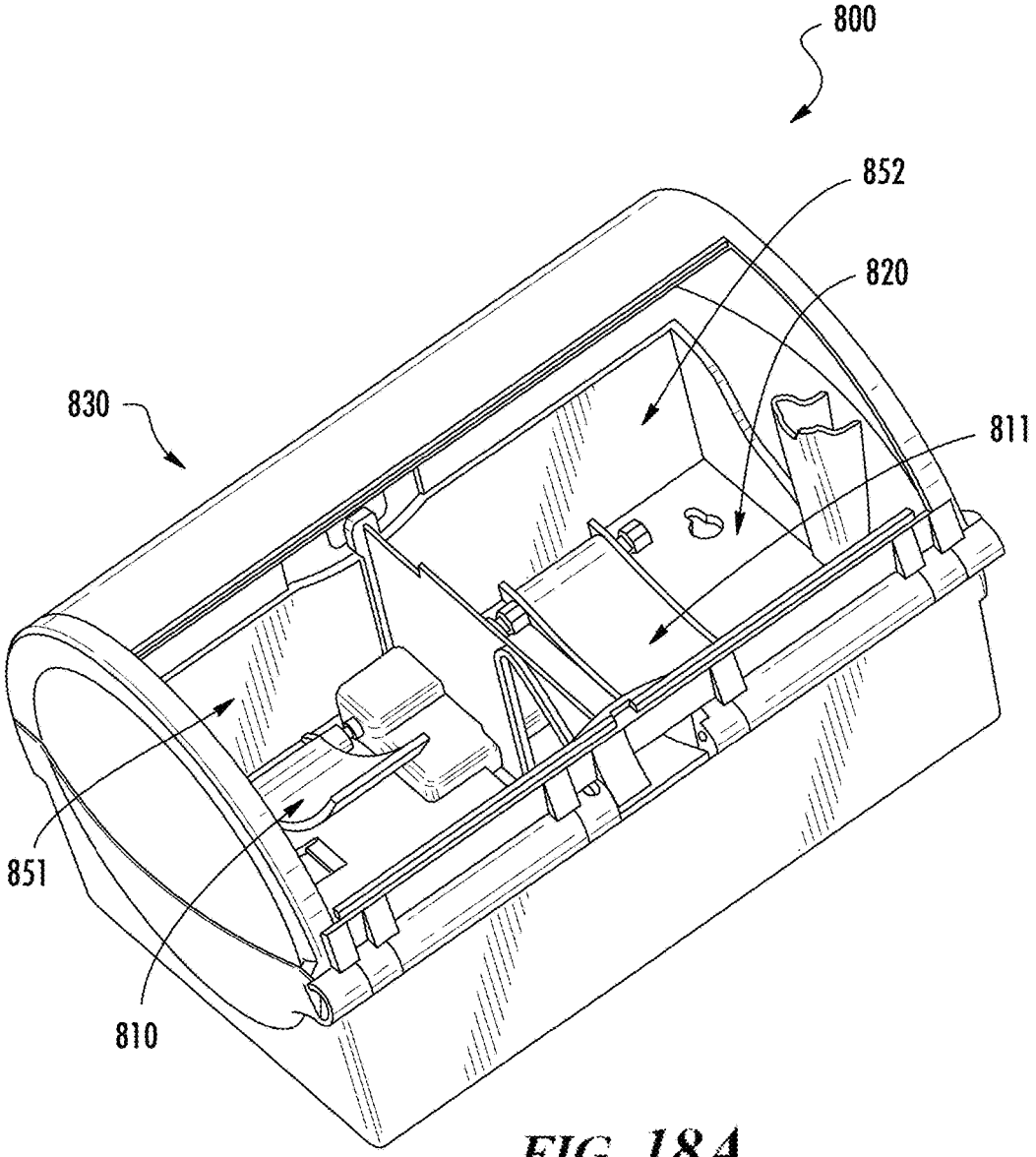
Figure 18B:
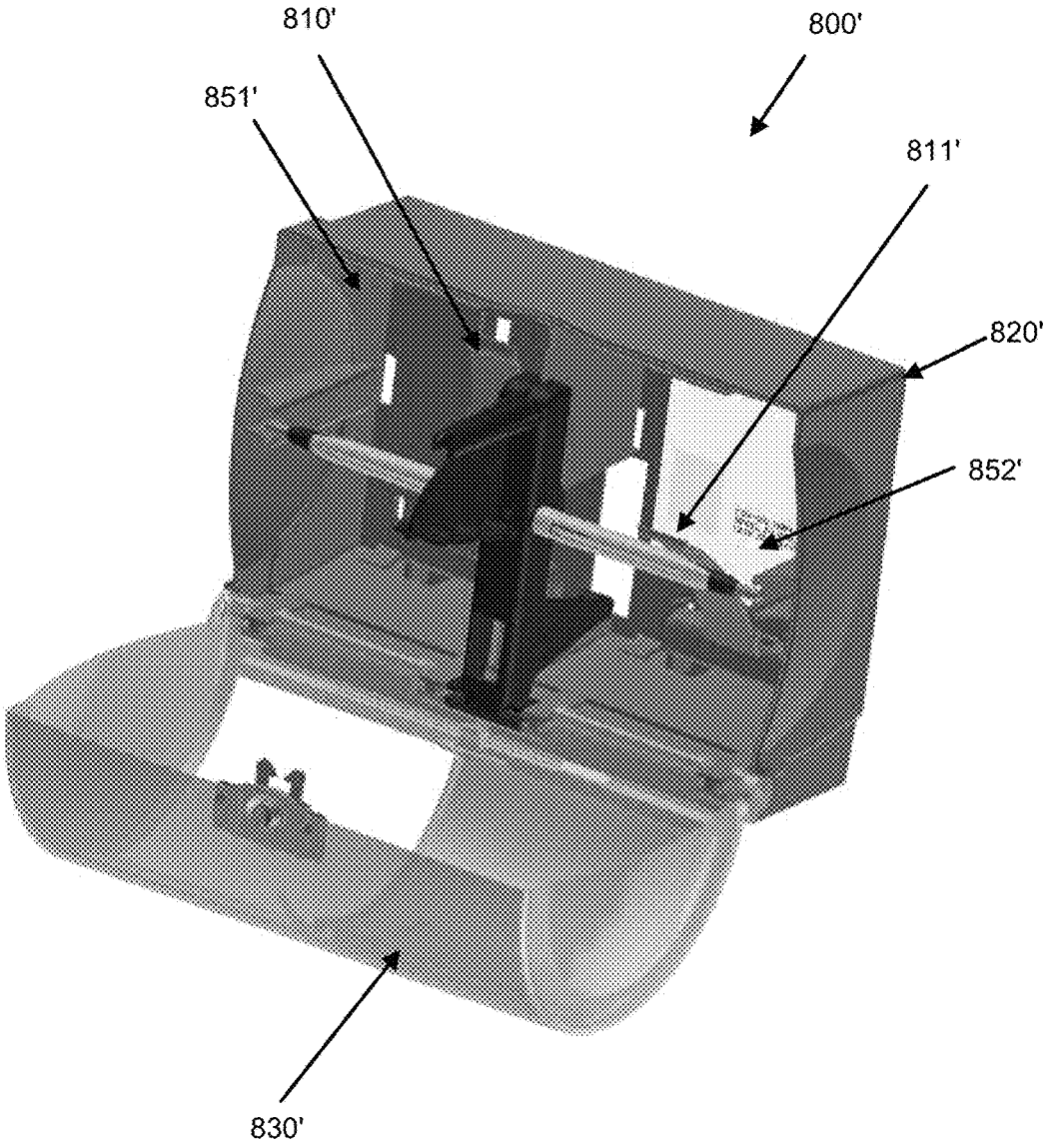

Having thus described the invention in general terms, reference will now be made to the accompanying drawings, which are not necessarily drawn to scale, and wherein:

FIG. 1 is a perspective view of an example sheet product dispenser, wherein the sheet product dispenser is a multi-roll dispenser and includes a partially transparent cover, in accordance with some embodiments discussed herein;

FIG. 2 is a perspective view of the sheet product dispenser of FIG. 1 with the cover open and a first roll of sheet product positioned in the primary roll position for dispensing, in accordance with some embodiments discussed herein;

FIG. 2A is a schematic illustration of components of an example sheet product dispenser, such as the sheet product dispenser of FIG. 1, in accordance with some embodiments discussed herein;

FIG. 3 is a perspective view of the sheet product dispenser of FIG. 2 with a reduced amount of sheet product on the first roll, in accordance with some embodiments discussed herein;

FIG. 4 is a perspective view of the sheet product dispenser of FIG. 3, wherein the first roll is repositioned into a secondary roll position for dispensing and a user is installing another roll in the primary roll position, in accordance with some embodiments discussed herein;

FIG. 5 is a perspective view of the sheet product dispenser of FIG. 4 with two rolls of sheet product installed, in accordance with some embodiments discussed herein;

FIG. 6A is a perspective view of an example sensor for monitoring the fuel gauge of a roll of sheet product, in accordance with some embodiments discussed herein;

FIG. 6B is a perspective view of the sensor of FIG. 6A installed on the cover of an example sheet product dispenser, in accordance with some embodiments discussed herein;

FIG. 6C is a perspective view of another example sensor for monitoring the fuel gauge of a roll of sheet product, in accordance with some embodiments discussed herein;

FIG. 6D is a perspective view of the sensor of FIG. 6C installed on the cover of an example sheet product dispenser, in accordance with some embodiments discussed herein;

FIG. 7A shows another example sensor for monitoring the fuel gauge of a roll of sheet product, in accordance with some embodiments discussed herein;

FIG. 7B shows yet another example sensor for monitoring the fuel gauge of a roll of sheet product, in accordance with some embodiments discussed herein;

FIG. 8A illustrates a cross-sectional view of an example sheet product dispenser with a roll of sheet product and a fuel gauge sensor (e.g., the example sensors shown in either FIG. 6A or 6C), wherein the solid lines indicate a time when the roll of sheet product is full and the dashed lines indicate a time when at least a portion of the roll of sheet product has been depleted (or significantly reduced), in accordance with some embodiments discussed herein;

FIG. 8B illustrates another cross-sectional view of an example sheet product dispenser with a roll of sheet product and a fuel gauge sensor (e.g., the example sensors shown in either FIG. 6A or 6C), wherein the roll of sheet product is deformed, in accordance with some embodiments discussed herein;

FIG. 8C illustrates a side view of an example roll of sheet product and a fuel gauge sensor (e.g., the example sensor shown in FIG. 7A), in accordance with some embodiments discussed herein;

FIG. 9A is a schematic of an example fuel gauge monitoring system, in accordance with some embodiments discussed herein;

FIG. 9B is a schematic of another example fuel gauge monitoring system, in accordance with some embodiments discussed herein;

FIG. 10A is a schematic of another example fuel gauge monitoring system, in accordance with some embodiments discussed herein;

FIG. 10B is a front view of another example sheet product dispenser, in accordance with some embodiments discussed herein;

FIG. 11 illustrates an example transmission signal of measurement data, in accordance with some embodiments discussed herein;

FIG. 11A illustrates an example encoded analog signal of measurement data, in accordance with some embodiments discussed herein;

FIG. 11B illustrates an example encoded digital signal of measurement data, in accordance with some embodiments discussed herein;

FIG. 12 is a flowchart that illustrates an example method for monitoring measurement data from an example fuel gauge sensor and for determining situational information regarding an example sheet product dispenser, in accordance with some embodiments discussed herein;

FIG. 13 is a perspective view of another example sheet product dispenser, in accordance with some embodiments discussed herein;

FIG. 14 is a perspective view of the sheet product dispenser of FIG. 13 with the cover open, in accordance with some embodiments discussed herein;

FIG. 15 is a perspective view of an example non-automated (mechanical) sheet product dispenser, in accordance with some embodiments discussed herein;

FIG. 15A is a perspective view of the sheet product dispenser of FIG. 15, wherein the cover is open and the roll of sheet product is removed, in accordance with some embodiments discussed herein;

FIG. 15B is a perspective view of the sheet product dispenser of FIG. 15, wherein the cover is open and the roll of sheet product is installed, in accordance with some embodiments discussed herein;

FIG. 16 is a perspective view of another example non-automated (mechanical) sheet product dispenser, in accordance with some embodiments discussed herein;

FIG. 17 is a front view of an example tissue dispenser, in accordance with some embodiments discussed herein;

FIG. 18A is a perspective view of the tissue dispenser of FIG. 17 with the cover open, wherein an example sensor is attached to a portion of the tissue dispenser, in accordance with some embodiments discussed herein; and FIG. 18B is a perspective view of another example tissue dispenser with the cover open, wherein an example sensor is attached to a portion of the tissue dispenser, in accordance with some embodiments discussed herein.

DETAILED DESCRIPTION

Embodiments of the present invention now will be described more fully hereinafter with reference to the accompanying drawings, in which some, but not all embodiments of the invention are shown. Indeed, these embodiments may take many different forms and should not be construed as limited to the embodiments set forth herein; rather, these embodiments are provided so that this disclosure will satisfy applicable legal requirements. Like numbers refer to like elements throughout.

FIGS. 1-5 illustrate an example multi-roll sheet product dispenser 10. With reference to FIG. 1, the sheet product dispenser includes a housing 22 defined by a back portion 20 and a partially-transparent cover 30. The sheet product dispenser 10 includes a dispensing slot 25 where the sheet product (e.g., paper towel) is provided to the user.

The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentagled (sometimes called spunlace), DRC (double re-creped), airlaid, spunbond, carded, paper towel, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, paper towels or other fibrous, film, polymer, or filamentary products.

With reference to FIG. 2, the sheet product dispenser 10 includes a first roll holder 70 and a second roll holder 75 positioned within the housing 22. Each roll holder 70, 75 is configured to receive and hold a roll of sheet product (e.g., sheet product roll 50 is held by the first roll holder 70). Though the above described multi-roll dispenser includes two roll holders, embodiments of the present invention are not meant to be limited to two roll holders, as any number of roll holders may be utilized with the present invention.

A schematic representation of components of the example sheet product dispenser 10 is shown in FIG. 2A. It should be appreciated that the illustration in FIG. 2A is for purposes of description and that the relative size and placement of the respective components may differ. The sheet product dispenser 10 includes a controller 200. As will be described in more detail herein, the controller 200 provides logic and control functionality used during operation of the sheet product dispenser 10. Alternatively, the functionality of the controller 200 may be distributed to several controllers that each provides more limited functionality to discrete portions of the operation of sheet product dispenser 10. The controller 200 is coupled to a dispensing mechanism 27 to dispense a sheet product 26 when activated by a user. A motor 42 and an optional transmission assembly 44 drive the dispensing mechanism 27. The optional transmission assembly 44, such as a gearbox for example, adapts the rotational output of the motor 42 for the dispensing of the sheet product 26.

In the exemplary embodiment, the electrical energy for operating the sheet product dispenser 10 is provided by a battery 46, which may be comprised of one or more batteries arranged in series or in parallel to provide the desired energy. In the exemplary embodiment, the battery 46 includes four 1.5-volt "D" cell batteries. The battery 46 is connected to the controller 200, and may be connected via an optional power converter 48 that adapts the electrical output of the battery 46 to that desired for operating the sheet product dispenser 10. The optional power converter 48 may also accept an input from an external power source, such as an alternating current ("AC") power source 49 or a solar power source, or any other alternative power source as may be appropriate for an application. The AC power source 49 may be any conventional power source, such as a 120V, 60 Hz wall outlets for example. The controller 200 is a suitable electronic device capable of executing dispenser functionality via hardware and/or software control, with the preferred embodiment accepting data and instructions, executing the instructions to process the data, and presenting the results. Controller 200 may accept instructions through a user interface, or through other means such as but not limited to an activation sensor, other sensors, voice activation means, manually-operable selection and control means, radiated wavelength and electronic or electrical transfer. Therefore, controller 200 can be, but is not limited to a microprocessor, microcomputer, a minicomputer, an optical computer, a board computer, a complex instruction set computer, an ASIC (application specific integrated circuit), a reduced instruction set computer, an analog computer, a digital computer, a molecular computer, a quantum computer, a cellular computer, a solid-state computer, a single-board computer, a buffered computer, a computer network, a desktop computer, a laptop computer, a personal digital assistant (PDA) or a hybrid of any of the foregoing.

The sheet product dispenser 10 shown in FIG. 1 is an automated dispenser. As such, the controller 200 may be configured to determine when the activation sensor 35 is activated and/or when a portion of the sheet product is dispensed. For example, in some embodiments, the sheet product dispenser 10 may include an activation counter that is configured to determine when the activation sensor 35 is activated. The activation counter may be incremented each time the activation sensor 35 senses the presence of a user and/or the dispensing mechanism 27 operates to dispense a portion of the sheet product. Additionally or alternatively, in some embodiments, the sheet product dispenser 10 may include a dispensing sensor that is configured to determine when, and in some cases, how much a portion of the sheet product is dispensed. Such a dispensing sensor may be positioned proximate the dispensing slot 25 and/or the dispensing mechanism 27.

Controller 200 is operably coupled with one or more components of the sheet product dispenser 10, such as by data transmission media 54. Data transmission media 54 includes, but is not limited to, solid-core wiring, twisted pair wiring, coaxial cable, and fiber optic cable. Data transmission media 54 also includes, but is not limited to, wireless, radio and infrared signal transmission systems. Controller 200 is configured to provide operating signals to these components and to receive data from these components via data transmission media 54. Controller 200 communicates over the data transmission media 54 using a well-known computer communications protocol such as Inter-Integrated Circuit (I2C), Serial Peripheral Interface (SPI), System Management Bus (SMBus), Transmission Control Protocol/Internet Protocol (TCP/IP), RS-232, ModBus, or any other communications protocol suitable for the purposes disclosed herein.

As will be described in more detail herein, controller 200 accepts data from sensors (e.g., sensor 100 shown in FIG.

6A, sensor 310 shown in FIG. 6C, sensor 360 shown in FIG. 7A, or sensor 390 shown in FIG. 7B) and devices such as motor 42 for example.

Controller 200 includes a processor (e.g., microcontroller 82) coupled to a random access memory (RAM) device 84, a non-volatile memory (NVM) device 86, and a read-only memory (ROM) device 88. Controller 200 may optionally be connected to one or more input/output (I/O) controllers or data interface devices (not shown). NVM device 86 is any form of non-volatile memory such as an EPROM (Erasable Programmable Read Only Memory) chip, a flash memory chip, a disk drive, or the like. Stored in NVM device 66 are various operational parameters for the application code. It should be recognized that application code could be stored in NVM device 86 rather than ROM device 88.

Controller 200 includes operation control methods embodied in application code. These methods are embodied in computer instructions written to be executed by processor 82, typically in the form of software. The software can be encoded in any language, including, but not limited to, machine language, assembly language, VHDL (Verilog Hardware Description Language), VHSIC HDL (Very High Speed IC Hardware Description Language), Fortran (formula translation), C, C++, Visual C++, Java, ALGOL (algorithmic language), BASIC (beginners all-purpose symbolic instruction code), visual BASIC, ActiveX, HTML (HyperText Markup Language), and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

In some embodiments, the controller may be configured to define the size of the portion of sheet product that is dispensed by the sheet product dispenser 10. In this regard, the controller may instruct the dispensing mechanism 27 to dispense a certain size of the portion (e.g., 8 in., 12 in., 16 in., etc.) of sheet product. In some embodiments, the controller may be configured to change the size of the portion of sheet product that is dispensed, such as changing the size of the portion of sheet product to 4 inches.

In some instances, with reference to FIG. 5, the sheet product dispenser 10 may be loaded with both a first roll of sheet product 50 and a second roll of sheet product 55. Depending on the configuration of the sheet product dispenser 10, one of the first or second roll of sheet product may be assigned as a primary roll with the other being assigned as a secondary roll (sometimes referred to as a stub roll). In the depicted embodiment, the first roll of sheet product 50 is held by the first roll holder 70 and assigned as the primary roll with a leading edge 52 fitting into the dispensing mechanism 27. The second roll of sheet product 55 is held by the second roll holder 75 and assigned as the secondary roll with a leading edge 57 fitting into the dispensing mechanism 27.

During dispensing, the dispensing mechanism 27 may be configured to first pull and dispense a portion of the secondary roll prior to utilizing the primary roll. Sheet product from either the primary roll or the secondary roll is fed to a roller assembly 74 that includes a pair of rollers that pull the sheet product when activated by motor 42. A tear bar assembly 87 is positioned adjacent the dispensing slot 25 to provide a means for separating the dispensed sheet product 26 from the primary or secondary roll. A means for cutting the sheet product 26 is included in tear bar assembly 87 once the appropriate amount of sheet product 26 has been dispensed. Typically, this is accomplished using a serrated edge that cuts into the sheet when the user pulls the dispensed sheet product 26. The separation of the portion of the sheet product 26 from the primary or secondary roll may then be used and discarded as necessary by the user.

In some embodiments, the secondary roll may be used until it is depleted. Then, the dispensing mechanism 27 may be configured to transfer to pulling and dispensing a portion of the primary roll in order to maintain the ability to dispense continuously. Though the above described embodiment dispenses from the secondary roll first and the primary roll second, some embodiments of the present invention may be configured to dispense from the primary roll first and the secondary roll second.

Embodiments of the present invention may be configured to affect transfer between the primary roll and secondary roll in any of a number of different ways. For example, a transfer roller may be used to feed the product from the primary roll onto one or more rollers of the roller assembly 74 for dispensing after depletion of the secondary roll. In other embodiments, a transfer bar may be activated by an electromechanical actuator. The transfer bar may act to move an end portion of primary roll into engagement with the rollers in roller assembly 74 and may thereafter be dispensed.

As the secondary roll is dispensed, the amount of sheet product on the second roll of sheet product 55 decreases. In some embodiments, to ensure that at least some sheet product is always dispensed, the sheet product dispenser 10 may be configured to perform double sheeting. In this regard, as the amount of sheet product on the secondary roll approaches an empty condition, the dispensing mechanism 27 may be configured to begin also dispensing from the primary roll at the same time. In this regard, an amount of sheet product from both the secondary roll and the primary roll may be dispensed to a user. Double sheeting is useful for ensuring dispensing of at least some sheet product, especially when the amount of sheet product remaining on the secondary roll is not being directly measured and, instead, is being estimated.

In some embodiments, the controller may be configured to change the size of the portion of the secondary roll and primary roll being dispensed during double sheeting. For example, instead of dispensing 8 inches of sheet product from just the secondary roll, the controller may instruct the dispensing mechanism 27 to cause dispensing of 4 inches of sheet product from both the secondary roll and the primary roll.

In some embodiments, the sheet product dispenser 10 may be configured to enable reassignment of a roll of sheet product from a primary roll to a secondary roll. For example, with reference to FIG. 3, when the amount of sheet product remaining on the first roll 50 is nearly depleted or sufficiently reduced, a user (e.g., a janitor) may wish to reassign (e.g., reinstall) the first roll 50 from the primary roll position to the secondary roll position. By reassigning the first roll 50, a new roll of sheet product 50' may be positioned into the sheet product dispenser 10 and assigned as the primary roll. Moreover, as detailed above, dispensing may still occur from the first roll 50 first (now assigned as the secondary roll) and then seamlessly transition into dispensing from the new roll of sheet product 50' (assigned as the primary roll).

Depending on the configuration of the sheet product dispenser 10, reassignment may be enabled in a number of different ways. For example, with reference to FIG. 3, the first roll 50 may be held by the first roll holder 70. In order to reassign the first roll 50, a user may simply rotate the holder mechanism 73 (e.g., along arrow A) such that the first roll 50 and first roll holder 70 are positioned within the bottom of the housing 22 of the sheet product dispenser 10 (see FIG. 4). This rotation brings the second roll holder 75 to a position near the top of the housing 22 and enables installation of a new roll 50' by the user. The user can then feed a leading edge of the new roll 50' through the proper portion of the dispensing mechanism 27 to enable proper dispensing therefrom.

In the depicted embodiment, the shape of the cover 20 is formed to provide a reduced volume near the bottom of the housing (see FIG. 1). In this regard, the amount of sheet product on the first roll 50 needs to be reduced to a certain degree to enable it to properly fit within the housing when reassigned to become the secondary roll. In this manner, the secondary roll (often called the stub roll) has a diameter that is reduced as compared with the initial diameter of the roll of sheet product when first installed (see e.g., the difference in diameter between the first roll 50 and the new roll 50' in FIG. 4). In this regard, in some embodiments, it may be desirable to inform the user when the amount of sheet product on the first roll of sheet product has reduced to a sufficient point to enable reassignment from the primary roll to the secondary roll.

Though the above described embodiments employ a holder mechanism that enables rotation of the rolls of sheet product for reassignment between being the primary roll and secondary roll, embodiments of the present invention contemplate other ways to enable reassignment of the rolls of sheet product. For example, a user may manually remove the first roll from the first roll holder and install it into the second roll holder for reassignment as the secondary roll.

In some embodiments, the sheet product dispenser 10 may comprise a sensor configured to sense measurement data associated with the primary roll of a multi-roll sheet product dispenser. By sensing measurement data associated with the primary roll, embodiments of the present invention may be configured to determine certain situational information regarding the sheet product dispenser. Example situation information is described further herein.

The above described example embodiments are directed to automated multi-roll dispensers. Additional information regarding example automated multi-roll dispensers, including various components and capabilities can be found U.S. Pat. No. 8,616,489 and U.S. Publication No. 2013/0079923, both of which are commonly owned with the present invention and incorporated herein in their entireties.

Though the following description focuses on use of example sensors in an automated multi-roll sheet product dispenser, embodiments of the present invention contemplate use of example sensors in automated single roll sheet product dispensers (FIGS. 13-14), as well as in non-automated single and multi-roll sheet product dispensers (see e.g., FIGS. 15, 15A, 15B, and 16). In addition, though the described embodiments focus on sensing measurement data from the primary roll, some embodiments of the present invention contemplate sensing measurement data from other rolls within the sheet product dispenser. Further, though the described embodiments focus on paper towel dispensers, other types of dispensers are contemplated for use with the sensors described herein, including tissue dispensers (see e.g., FIGS. 17, 18A, and 18B).

FIG. 6A shows an example sensor 100 that includes a paddle body 110 and a roller 120. The paddle body 110 defines a first end 124 and a second end 123. With reference to FIG. 6B, the paddle body 110 may be rotatably attached to the housing 22 (e.g., the backing 20) and configured to pivot around an axis $A_{PB}$. The roller 120 is positioned proximate the second end 123 of the paddle body 110 and may be configured to rotate around the axis $A_R$. In some embodiments, the roller 120 may be configured to trigger switch "S" as it rotates, thereby indicating rotation of the outer surface of the primary roll. As shown in FIG. 8A, the sensor 110 may be configured to interact with the primary roll (e.g., roll 51) and, in some embodiments, the outer surface of the primary roll to sense measurement data associated with the primary roll.

FIG. 6C shows another example sensor 310 that includes a paddle body 311 and a roller 312. The paddle body 311 may, in some embodiments, be similar in configuration to the paddle body 110 of sensor 100. Likewise, the roller 312 may, in some embodiments, be similar in configuration to the roller 120 of sensor 100. FIG. 6B shows the sensor 310 rotatably attached to a housing 22 (e.g., the backing 20) such that it is configured to acquire measurement data associated with a sheet product roll of the sheet product dispenser 10.

FIG. 7A shows another example sensor 360 that includes a first arm 372, a second arm 376, and a roller 365. Each arm may include a first end (e.g., first end 373 of the first arm 372 and first end 377 of second arm 376) and a second end (e.g., second end 374 of the first arm 372 and second end 378 of second arm 376). The second end of each arm may be attached to the sheet product dispenser (such as the backing 20 of the housing of the sheet product dispenser). The first end of each arm may be configured to linearly displace with respect to the second end (such as described in greater detail with respect to FIG. 8C). The roller 365 may, in some embodiments, be similar in configuration to the roller 120 of sensor 100. For example, the roller 365 may be configured to rotate around axis 361. Further, the roller 365 may contact an outer surface 53 of a roll of sheet product 51 such that the roller 365 rotates with the outer surface 53 as the roll of sheet product 51 rotates around axis 367.

FIG. 7B shows another example sensor 390 that includes a first arm 392, a second arm 396, and a roller 395. Each arm may include a first end (e.g., first end 393 of the first arm 392) and a second end (e.g., second end 394 of the first arm 392). The second end of each arm may be attached to the roll of sheet product (such as to a spindle for the roll of sheet product that rotates around the axis 367). The first end of each arm may be configured to linearly displace with respect to the second end (e.g., similar to as described in greater detail with respect to FIG. 8C). The roller 395 may, in some embodiments, be similar in configuration to the roller 120 of sensor 100. For example, the roller 395 may be configured to rotate around axis 399. Further, the roller 395 may contact an outer surface 53 of a roll of sheet product 51 such that the roller 395 rotates with the outer surface 53 as the roll of sheet product 51 rotates around axis 367.

In some embodiments, the sensor (e.g., sensor 100, sensor 310, sensor 360, and/or sensor 390) is configured to sense multiple types of information associated with the primary roll of the sheet product dispenser. For example, the sensor may be configured to sense when the primary roll rotates to dispense the portion of the sheet product. Additionally, the sensor may also be configured to measure the amount of sheet product remaining on the primary roll (such as by measuring the diameter of the roll of sheet product). In some embodiments, such information can be used to measure or form a remaining sheet length value (e.g., 0%-100% remaining sheet). Additionally or alternatively, the information can be used to measure or form a remaining product level in reference to the diameter of the roll (e.g., 0%-100% remaining diameter). In some embodiments, certain values or measurements regarding the roll of sheet product may be determined through the sensors in conjunction with known product parameters (e.g., density of the roll of sheet product, overall starting length of the sheet product, etc.). In this regard, in some embodiments, various techniques may be used to identify the specific roll of sheet product (allowing use of known parameters) or to identify the specific parameters of the roll of sheet product being currently used.

In some embodiments, determination of the remaining product level can be accomplished by the direct measurement of the roll diameter, and therefore can provide a fuel gauge measurement in terms of roll diameter. The fuel gauge measurement may also be provided in relation to the remaining sheet length on the roll of sheet product. This may require conversion of the diameter measurement into remaining sheet length.

The following equation 1 can be used to convert between roll diameter and remaining sheet length. Where L equals the roll length, t equals the product material thickness, d equals the core diameter, D equals the outside surface diameter, r equals the core radius, and R equals the outside surface radius.

$$R = \sqrt{(L * \frac{t}{\pi} + r^2)} \tag{1}$$

The above conversion requires knowledge of product roll characteristics including the material thickness, core diameter, and outside diameter. In some embodiments, capable hardware (e.g., microcontroller 82) can perform the conversion in software through mathematical equations or via lookup tables. As such, the dispenser may be configured to perform some level of product identification in order to obtain the parameters necessary to convert diameter measurements into remaining sheet length data. Product identification can be performed in a number of ways, including preset configuration, programmable configuration, and automated discovery (e.g. RFID, paper pattern detection, electroluminescence, optical detection, electrical signature, mechanical key detection, size and weight detection, etc.). Although not directly involved in calculating remaining sheet length and fuel gauge levels, other characteristics related to the product type, material, and other product properties may provide information beneficial for product specific dispensing parameters and compatibility assessment.

In some embodiments, the sensor may be configured to measure the amount of sheet product remaining without measuring the circumference of the roll of sheet product (e.g., without measuring the distance of travel of the sheet product on the roll or a distance of travel of a roller sensor contacting the outer surface of the roll of sheet product). This can be accomplished, for example, even while contacting the roll of sheet product. In this regard, some example sensors described herein (e.g., sensor 100, sensor 310, sensor 360, and/or sensor 390) may be configured to measure at least one of angular displacement of the sensor around a pivot axis connecting the sensor to the housing or linear displacement of a first portion (e.g., first end) of the sensor with respect to a second portion (e.g., second end) of the sensor to enable determination of an amount of sheet product remaining on at least the one of the primary roll or the secondary roll. Such example sensor configurations will be described in greater detail herein.

In some embodiments, the sensor is configured to measure angular displacement of the sensor around the pivot axis to enable determination of an amount of sheet product remaining on the roll of sheet product. The sensor may be configured to measure angular displacement of the second end of the sensor from prior to an instance of dispensing of the portion of the sheet product to after the instance of dispensing of the portion of the sheet product. For example, the sensor may be configured to rotate between at least a first position defined prior to an instance of dispensing of the portion of the sheet product and a second position defined after the instance of dispensing of the portion of the sheet product. In this case, the sensor may measure the angular displacement between the first position and the second position to enable determination of an amount of sheet product remaining on the roll of sheet product after the instance of dispensing of the portion of the sheet product.

FIG. 8A illustrates an example sensor 100 with a paddle body 110 that is configured to measure the amount of sheet product remaining on the primary roll 51. In the depicted embodiment, the paddle body 110 rotates around the axis $A_{PB}$ in response to reduction of the diameter of the primary roll 51. For example, at a first time (shown in solid lines), the roller 120 (at the second end of the paddle body) contacts the outer surface 53 of the primary roll 51, which indicates a first diameter $D_1$ of the primary roll. After dispensing, however, the amount of sheet product on the primary roll decreases, which results in the primary roll 51' having a decreased diameter $D_2$ (see the broken lines). This results in angular movement of the sensor 100' and paddle body 110'. Since the degree of that angular movement θ is directly related to the diameter of the primary roll, the sensor can accurately measure the diameter of the roll of sheet product and, thus, the amount of sheet product remaining on the primary roll.

FIG. 8A also illustrates an example sensor 100 with a roller 120 that is configured to sense when the primary roll rotates (and, thus, dispenses sheet product). In the depicted embodiment, the roller 120 is configured to contact the outer surface 53 of the primary roll 51. As dispensing occurs from the primary roll 53, the primary roll 53 will rotate, which will also cause the roller 120 to rotate. The sensor 100 can sense this rotation for use with the measurement data. As shown in broken line, as the amount of sheet product on the primary roll 51' is reduced, the roller 120' maintains contact with the outer surface 53' of the primary roll 51', thereby enabling continued sensing of when the primary roll rotates.

Though the above described embodiments detail a sensor with a paddle body and a roller, other sensors are contemplated for use with some embodiments of the present invention (e.g., non-pivoting sensors, flexible position sensors, strain gauges, etc.).

For example, in some embodiments, the sensor is configured to measure linear displacement of a first end of a sensor with respect to a second end of the sensor where the first end contacts the roll of sheet product and the second end is attached to a fixed structure relative to the roll of sheet product (e.g., the backing of a housing (such as shown in FIG. 7A) or an axis of the roll of sheet product (such as shown in FIG. 7B)). Such linear displacement may be used to enable determination of an amount of sheet product remaining on the roll of sheet product. The sensor may be configured to measure linear displacement of the first end of the sensor from prior to an instance of dispensing of the portion of the sheet product to after the instance of dispensing of the portion of the sheet product. For example, the sensor may be configured to move between at least a first position defined prior to an instance of dispensing of the portion of the sheet product and a second position defined after the instance of dispensing of the portion of the sheet product. In this case, the sensor may measure the linear displacement between the first position and the second position to enable determination of an amount of sheet product remaining on the roll of sheet product after the instance of dispensing of the portion of the sheet product.

FIG. 8C illustrates an example sensor 360 with at least one arm 372 that is configured to measure the amount of sheet product remaining on the primary roll 51. In the depicted embodiment, the first end 373 of the arm 372 moves with respect to the second end 374 of the arm 372 along arrow 363 in response to reduction of the diameter of the primary roll 51. The example sensor 390, with reference to FIG. 7B, similarly has a first end 393 of an arm 392 that moves with respect to the second end 394 of the arm 392 along arrow 364 in response to reduction of the diameter of the primary roll 51. Since the distance of the measured linear movement is directly related to the diameter of the primary roll, the sensor can accurately measure the diameter of the roll of sheet product and, thus, the amount of sheet product remaining on the primary roll.

Due to various factors (e.g., shipping, age, storage, environment, temperature, among others) the rolls of sheet product may become deformed. For example, the rolls of sheet product may form more of an oval-shaped cross-section rather than the ideal circular cross-section. To account for such deformation, some embodiments of the present invention provide a flexible paddle body 110. For example, with reference to FIG. 8B, the cross-sectional shape of the primary roll 51 may make it so that a rigid paddle body 110 would result in the roller 120 not maintaining contact with the outer surface 53. Instead, as shown in FIG. 8B, as the oval-shape cross-section rotates, the paddle body 110 flexes to enable continued contact between the roller 120 and the outer surface 53 of the primary roll 51.

Additionally, however, the sensor 100 may be configured to account for any fluctuations in angular measurements to provide a more accurate reading of the amount of sheet product remaining. For example, a smoothing filter can be applied to the measurement data over a rotation cycle. In particular, a slow multi-point moving average algorithm can be used to ensure that the peaks and valleys do not cause the measurements to vary.

Some embodiments of the present invention contemplate collection and use of the measurement data. In this regard, the sensor may be in communication with a controller, a memory, and a data communication device. In some embodiments, measurement data may be transmitted to a remote device, such as a server, other controller, the cloud, etc. (see e.g., FIGS. 9A and 9B). Additionally or alternatively, the measurement data may be utilized internally and resulting information may be presented to a user on a local display of the sheet product dispenser (see e.g., FIGS. 10A and 10B).

Some embodiments of the present invention have been contemplated for use as part of a HHC (Health Hygiene Compliance) system, where in such systems it is essential to ensure there is product available (and product is used) during an HHC event so compliance can be achieved. The system may further ensure compliance by prompting the participant (through audio or visual prompts) to utilize a specific dispenser in the vicinity as required, based on product availability and/or a specific contained product type.

As described in greater detail herein, in some embodiments, the measurement data can be processed to determine situation information concerning the sheet product dispenser 10, 10'. This processing may occur locally or, in some cases, at the remote device (such as on a controller of the remote device). In this regard, determination of situation information described herein with respect to the controller 200, 200' can be extended, in some embodiments, to a controller on the remote device. Additionally, such situational information may be transmitted to the remote device 300 from the data communications device 210, 210'.

Depending on the configuration of the sensor and sheet product dispenser, the controller, memory, and/or data communication device may be contained within the sensor (e.g., sensor 100, sensor 310, sensor 360, and/or sensor 390) or the sensor (e.g., sensor 100, sensor 310, sensor 360, and/or sensor 390) may utilize the controller, memory, and/or data communication device of the sheet product dispenser (e.g., in an instance in which the sheet product dispenser is automated and includes a controller of its own).

FIG. 9A illustrates an example sheet product dispenser 10 that includes its own controller 200, memory 205, and data communication device 210. In such an embodiment, the controller 200 may be the same controller that instructs the dispensing mechanism 27 to dispense the sheet product in response to receiving an activation signal. The sensor 101 (e.g., sensor 100, sensor 310, sensor 360, and/or sensor 390) may be in communication with the controller 200, which may receive the measurement data. Additionally, the controller 200 may instruct the data communication device 210 to transmit the measurement data, such as to a remote device 300. Additionally, as described herein, the controller 200 may be configured to process the measurement data to determine situational information concerning the sheet product dispenser 10.

FIG. 9B illustrates an example sheet product dispenser 10' that has a self-contained sensor 101' installed. Notably, the sensor 101' (e.g., sensor 100, sensor 310, sensor 360, and/or sensor 390) includes its own controller 200', memory 205', and data communication device 210'. Additionally, however, the sensor 100' also includes a battery 190. In such an embodiment, the controller 200' of the sensor 100' may receive the measurement data and instruct the data communication device 210' to transmit the measurement data, such as to a remote device 300. Additionally, as described herein, the controller 200' may be configured to process the measurement data to determine situational information concerning the sheet product dispenser 10'. Such a self-contained (and self-powered) sensor 100' may be utilized in a non-automated (e.g., mechanical) sheet product dispenser (see e.g., FIGS. 15-16). With reference to FIG. 6A, the controller 200', memory 205', data communication device 210', and/or battery 190 may be attached to the sensor 100' at, for example, the paddle body 110 to form a single, self-powered unit.

In some embodiments, the electrical energy may be derived from a battery source. In such embodiments, it is essential to utilize low energy usage techniques to maximize battery life and minimize user intervention and maintenance costs. Standard low energy design techniques involve using hardware low power modes and the use of periodic interrupts (and/or polling methods) to wake up the controller to make measurements and process data. This requires a portion of the hardware peripherals to always remain active, and thus does not utilize the lowest possible energy states of the hardware. This invention provides advantages over prior art, in that the electronics can remain in the lowest possible energy state until either roller activity or a host message briefly wakes up the module to process current data, and then goes back to a low energy state. It can therefore maintain real-time performance and utilize the lowest energy possible. Those familiar in the art can appreciate the conservation of energy and use of energy only during dispenser events. This technique can be used in all mentioned and contemplated embodiments.

The controller 200, 200' may be any means such as a device or circuitry operating in accordance with software or otherwise embodied in hardware or a combination of hardware and software (e.g., a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the controller 200, 200' as described herein. In some example embodiments, the controller 200, 200' may be in communication with the data communication device 210, 210', the memory 205, 205', the sensor 100, 100', and the battery 190. In some embodiments, the controller 200, 200' is configured to execute instructions stored in the memory 205, 205' or otherwise accessible to the controller 200, 200'. As such, whether configured by hardware or software methods, or by a combination thereof, the controller 200, 200' may comprise an entity capable of performing operations according to embodiments of the present invention while configured accordingly.

The memory 205, 205' may comprise, for example, volatile memory, non-volatile memory, or some combination thereof. In this regard, the memory 205, 205' may comprise a non-transitory computer-readable storage medium. Although illustrated as a single memory, the memory 205, 205' may comprise a plurality of memories. The plurality of memories may be embodied on a single computing device or may be distributed across a plurality of computing devices collectively configured to function as desired. In various example embodiments, the memory 205, 205' may comprise a hard disk, random access memory, cache memory, flash memory, a compact disc read only memory (CD-ROM), digital versatile disc read only memory (DVD-ROM), an optical disc, circuitry configured to store information, or some combination thereof.

The data communication device 210, 210' may be embodied as any device or means embodied in circuitry, hardware, a computer program product comprising computer readable program instructions stored on a computer readable medium (e.g., the memory) and executed by a processing device (e.g., the controller), or a combination thereof that is configured to receive and/or transmit data from/to another computing device. In some example embodiments, the data communication device 210, 210' is at least partially embodied as or otherwise controlled by the controller. In this regard, the data communication device 210, 210' may be in communication with the controller, such as via a bus. The data communication device 210, 210' may include, for example, an antenna, a transmitter, a receiver, a transceiver and/or supporting hardware or software for enabling communications with one or more remote computing devices. The data communication device 210, 210' may be configured to receive and/or transmit data using any protocol that may be used for communications between computing devices. In this regard, the data communication device 210, 210' may be configured to receive and/or transmit data using any protocol that may be used for transmission of data over a wireless network, wireline network, some combination thereof, or the like.

In some embodiments, the data communication device 210, 210' may be configured to transmit measurement data. Additionally or alternatively, in some embodiments, the data communication device 210, 210' may be configured to transmit additional information, such as alerts or other information in accordance with example embodiments described herein.

As noted above, in some embodiments, the data communication device 210, 210' is configured to transmit a signal that contains the measurement data received by the sensor 101, 101'. In this regard, the data communication device 210, 210' may be configured to transmit a single signal that contains information indicating both (i) when the primary roll rotates to dispense the portion of the sheet product, such as sensed by movement of the roller, and (ii) the diameter of the primary roll, such as measured by the angular displacement of the paddle body. Thus, the data communication device 210, 210' may be configured to transmit an encoded signal that indicates both sets of measurement data. FIG. 11 illustrates an example encoded signal 400 that defines an amplitude 410 that corresponds to the fuel gauge measurement of the primary roll, such as the remaining length of sheet product, the diameter of the primary roll, etc., (e.g., the angular measurement of the paddle body 110) and a pulse 420 that indicates rotation of the primary roll (e.g., rotation of the roller 120). In some embodiments, the amplitude may correspond to a percentage remaining of sheet product, diameter, etc. Such an encoded signal provides a unique advantage of portraying two sets of measurement information in a single signal.

FIG. 11A shows an example of an encoded analog signal 400' that has a variable amplitude 410' and pulses 420'. The variable amplitude 410' provides an indication of the fuel gauge measurement of the primary roll (e.g., amount of sheet product remaining, diameter, etc.), wherein the potential variation in amplitude is denoted as Δ Sensor Level'. In some embodiments, the amplitude 410' corresponds to a percentage of the fuel gauge measurement. The pulses 420' indicate rotation of the primary roll. Such an embodiment may accommodate a host interface that can use an Analog/Digital converter to capture the fuel gauge level. The pulses can be captured with a digital input (e.g., interrupt, counter, etc.). In embodiments where the sensor 100 is utilized with a single roll dispenser, the fuel gauge measurement may be simply captured as the analog amplitude.

FIG. 11B shows an example of an encoded digital signal 400" that has a constant amplitude 410" (Vcc) and pulses 420", but the distance between the pulses 420" varies (using pulse width modulation). The variation in distance between the pulses 420" provides an indication of the fuel gauge measurement of the primary roll (e.g., amount of sheet product remaining, diameter, etc.), wherein the potential variation between pulses is denoted as Δ Sensor Level". In some embodiments, the variation in distance between the pulses 420" corresponds to a percentage of the fuel gauge measurement. The pulses 420' indicate rotation of the primary roll. Such an embodiment may accommodate a host interface that does not have an available Analog to Digital input for analog measurement, or prefers a digital interface.

Using the measurement data, along with known or other sensed information, embodiments of the present invention may be configured to determine certain situational information regarding the sheet product dispenser 10. In some embodiments, the controller 200, 200' may be configured to determine the situational information based, at least, in part on the received measurement data (e.g., the amount of sheet product remaining on the primary roll and rotation of the primary roll).

For example, some embodiments of the present invention can determine any one of the following:

The amount of sheet product remaining on the primary roll;

If the primary roll has been sufficiently depleted to be reassigned to the secondary roll;

If reassignment of the first roll of sheet product from the primary roll to the secondary roll occurred;

Which roll (between the primary roll and the secondary roll) is currently dispensing;

The amount of sheet product remaining on the secondary roll; and/or

If double sheeting is occurring.

The above listed determined situational information examples are just some examples of situation information that may be determined using the received measurement data from example sensors 101, 101' described herein. In this regard, some embodiments of the present invention contemplate additional situation information that may be determined, including information not necessarily based on the received measurement data (e.g., low battery, improper functioning sensor, deformed primary roll, malfunction in the sheet product dispenser, among others).

In some embodiments, the controller 200, 200' may be configured to determine the amount of sheet product remaining on the primary roll. For example, based on the received measurement data corresponding to the diameter of the primary roll, the controller 200, 200' may determine the amount of sheet product remaining on the primary roll.

In some embodiments, the controller 200, 200' may be configured to determine if the primary roll has been sufficiently depleted to be reassigned to the secondary roll. For example, as detailed above, in some embodiments, the shape of the housing 22 of the sheet product dispenser 10 may dictate that the roll of sheet product assigned as the primary roll must be sufficiently depleted to fit within the housing 22 at the position for the secondary roll. In this regard, the roll of sheet product cannot have a diameter greater than a threshold diameter in order to fit within the housing 22 at the position for the secondary roll. As such, knowing the threshold diameter and the current amount of sheet product remaining on the primary roll (from the measurement data), the controller 200, 200' can determine when the primary roll is sufficiently small enough to enable reassignment to the secondary roll.

In some embodiments, the controller 200, 200' may be configured to determine if reassignment of the first roll of sheet product from the primary roll to the secondary roll occurred. For example, the controller may be configured to determine when the cover 20 is opened to facilitate reassignment and/or installation of a new roll of sheet product as the primary roll. In such a situation, it may be useful to determine if the user did actually reassign the roll that was the primary roll to become the secondary roll. In this regard, in some embodiments, the controller 200, 200' is configured, in an instance in which another roll of sheet product is positioned within the housing 22 and assigned to be the primary roll, to determine if the first roll of sheet product was reassigned to become the secondary roll. In this regard, knowing that the cover 20 was opened, the controller 200, 200' can then determine if subsequent dispensing is occurring from either the primary roll or the secondary roll. This is done by sensing if the primary roll is rotating when dispensing occurs. The controller 200, 200' may be configured to know when dispensing occurs based on a dispensing sensor or an activation counter, such as described above. If the primary roll is rotating during the subsequent dispensing, it can be assumed that the original roll of sheet product was not reassigned to the secondary roll and was, perhaps, thrown away. Alternatively, if the primary roll is not rotating during the subsequent dispensing, it can be assumed that the secondary roll is dispensing—thereby implying that the original roll of sheet product was reassigned to the secondary roll.

In some embodiments, the controller 200, 200' may be configured to determine which roll (between the primary roll and the secondary roll) is currently dispensing. For example, the controller 200, 200' may be configured to know when dispensing occurs based on a dispensing sensor or an activation counter, such as described above. Then based on whether the primary roll is sensed as rotating or not enables the controller 200, 200' to determine whether the primary roll is dispensing (if it is rotating) or the secondary roll is dispensing (if the primary roll is not rotating).

In some embodiments, the controller 200, 200' may be configured to determine the amount of sheet product remaining on the secondary roll. As noted above, the controller 200, 200' may be configured to know when the cover 20 is opened for installation of a new roll of sheet product as the primary roll and reassignment of the original roll of sheet product as the secondary roll. If it is determined that reassignment did occur, then the controller 200, 200' may be configured to determine the amount of sheet product remaining on the secondary roll. This is because the amount of sheet product of the original roll of sheet product at the time of reassignment is known from prior measurement data associated with the original roll when it was the primary roll. Based on this known amount and knowing (i) when dispensing occurs and (ii) the size of each portion of sheet product dispensed, the controller 200, 200' can know the amount of the sheet product remaining on the secondary roll.

In some embodiments, the controller 200, 200' may be configured to determine if double sheeting is occurring. As noted above, the controller 200, 200' may be configured to determine the amount of sheet product remaining on the secondary roll. Additionally, the controller 200, 200' can sense when the primary roll is rotating. Thus, if the amount of sheet product remaining on the secondary roll has not yet been depleted and the primary roll is also dispensing, then it can be determined that both the primary roll and the secondary roll are actively dispensing. In this regard, the controller 200, 200' is configured to determine an instance in which both the primary roll and the secondary roll are actively dispensing by (i) determining an instance in which the first roll of sheet product was reassigned to become the secondary roll; and (ii) determining an instance in which the primary roll of sheet product is actively dispensing and the amount of sheet product remaining on the secondary roll is greater than zero (e.g., not empty).

By determining the above situational information and/or measured data, users may be updated with associated information, updates, alerts, or suggestions, thereby enhancing the user experience. Such users may include any type of user, including the end user, the janitor, the inventory manager, a supplier, the manufacturer of the sheet product dispenser, etc. In this regard, some embodiments of the present invention contemplate providing any type of associated information, updates, alerts, or suggestions that may be useful to such users.

In some embodiments, the controller 200, 200' may be configured to provide the alert and or other information to a user through the data communications device 210, 210' (or, ultimately through the remote device 300). In this regard, in some embodiments, the alert or other information may be provided to a remote device operated by the user (e.g., remote device 300). Some example remote devices included, for example, a cell phone, a computer, a tablet, etc. The alert or other information may be provided in any form, such as text message, email, audible alert, etc.

Additionally or alternatively, the controller 200, 200' may be in communication with a display (e.g., display 85 of FIGS. 10A and 10B) and may be configured to present the alert or other information on the display and/or through other output means, such as through one or more speakers (e.g., audio output). The display 85 may be of any type with some examples including a plasma display panel (PDP), a liquid crystal display (LCD), a light-emitting diode (LED), an organic light-emitting diode display (OLED), electronic paper, eInk, ePaper, a pass-through display, a projector, a holographic display or the like. In some embodiments, the display 85 may, for example, be touch enabled for user input (e.g., one or more touch panels).

In some embodiments, the controller 200, 200' may be configured to determine an alert or other information to provide to the user based on the situational information and/or the measured data. In some embodiments, the alert may be designed to provide feedback to a user and, in some cases, may be responsive to a determination about situational information of the sheet product dispenser.

In some embodiments, the alert or other information may be associated with an amount of sheet product remaining on the primary roll and/or the secondary roll. For example, a text message could be sent to the inventory manager or janitor detailing the amount of sheet product remaining (e.g., the fuel gauge). Such information may be useful for inventory management, such as ordering or tracking purposes.

In some embodiments, the alert or other information may be associated with a condition of the primary roll indicating that the first roll of sheet product may be reassigned to become the secondary roll. For example, a message or alert could be sent to the janitor (or displayed on the dispenser) letting them know that it may be time to reassign the primary roll and insert a new primary roll.

In some embodiments, the alert or other information may be associated with whether the first roll of sheet product was successfully reassigned to become the secondary roll. For example, a message or alert could be sent to the janitor (or displayed on the dispenser) letting them know that reassignment was complete. An example message is presented as "REASSIGNMENT COMPLETE" on the display 85 of the sheet product dispenser 10 shown in FIG. 10B.

In some embodiments, the alert or other information may be associated with whether the primary roll or the secondary roll is actively dispensing. Such information may be sent to a remote device or displayed in some manner locally (e.g., words, emitted lights, audible signal, etc.).

Likewise, in some embodiments, the alert or other information may be associated with an instance in which both the primary roll and the secondary roll are actively dispensing. Such a message or information may be useful in determining if double sheeting is occurring.

The above described types of alert provide some example alerts that can be used in connection with embodiments described herein. In some embodiments, such alerts can be used to facilitate an automated product replenishment notification system.

Though the above described embodiments detail determination of the alert (or other information) at the controller 200, 200', some embodiments of the present invention contemplate such determination occurring remotely (e.g., at remote device 300). Likewise, such alerts or information can be provided to a user through the remote device 300, as embodiments of the present invention are not meant to be limited to providing such alerts or information directly from the controller 200, 200'/data communications device 210, 210'.

In some embodiments, the controller 200, 200' (or a controller of the remote device) may be configured to determine an adjustment that may be desirable to make regarding operation or management of the sheet product dispenser. Such an adjustment may be associated with the determined situational information. In some cases, the controller 200, 200' (or controller of the remote device) may be configured to provide the suggested adjustment to a user for possible implementation by the user. Additionally or alternatively, the controller 200, 200' (or controller of the remote device) may be configured to instruct the controller of the sheet product dispenser directly to make the adjustment (such as by adjusting a parameter of the sheet product dispenser). In some cases, a user of the adjusted sheet product dispenser may be provided with an alert indicating that the adjustment occurred.

Embodiments of the present invention contemplate any type of adjustment related to the determined situational information and/or measured data. Some example adjustments include changing the size of dispensed sheet product with each dispense, changing ordering habits regarding inventory management, performing maintenance on the sheet product dispenser, etc. For example, based on the measured data, the controller 200, 200' may determine that double sheeting is occurring. In response, the controller 200, 200' may determine an alert to provide to the user indicating the double sheeting. Additionally, however, the controller 200, 200' may determine a recommended adjustment to the size of each portion of sheet product being dispensed, or a change in the parameter of the sheet product dispenser to decrease or increase the amount of time for which double sheeting occurs.

FIG. 12 illustrates a flow chart showing an example embodiment 500 of a method for monitoring operation of a sheet product dispenser. The operations illustrated in and described with respect to FIG. 12 may, for example, be performed by, with the assistance of, and/or under the control of one or more components of the sheet product dispenser 10 (e.g., controller 200, 200', sensor 101, 101', data communications device 210, 210' etc.) or remote device 300.

Startup occurs at operation 501, with IDLE following at operation 502. At operation 503, a check for whether the cover is open may occur.

If the cover is open, operation 526 determines if paper feed occurred. If so, operation 527 determines if the roller cam clicks (e.g., the roller senses movement of the primary roll). If the roller cam clicks, operation 528 indicates (e.g., through an alert) that the stub (secondary) roll was not used. In this instance, the roll of sheet product that was previously the main (primary) roll was not reassigned to the stub (secondary) roll.

Once the cover is closed (operation 520), then operation 521 detects the presence of the main (primary) roll and operation 522 measures the remaining product of the main (primary) roll (e.g., using the angle measurement of the paddle body of the sensor). Then, at operation 523, the measurement is compared with the last fuel gauge (amount remaining) measurement of the prior main (primary) roll to confirm whether a change in the main (primary) roll did actually occur (e.g., if the measurements were substantially different). If a change in the main (primary) roll did occur, a roll reassignment flag is applied at operation 524, thereby assuming that the roll of sheet product that was previously the main (primary) roll was reassigned as the stub (secondary) roll. Next, at operation 525, the last known fuel gauge (amount remaining) measurement of the prior main (primary) roll is set as the fuel gauge for the stub (secondary) roll.

Returning to IDLE at operation 502, if a dispensing occurs (operation 504), then operation 505 commences with a sheet dispense.

If the roller cam does not click at operation 506 (e.g., the roller does not sense movement of the primary roll), then operation 530 determines if a sheet is dispensed.

If a sheet is dispensed, then operation 531 subtracts the expected dispensed sheet length from the stored fuel gauge (amount remaining) of the stub (secondary) roll. Additionally, operation 532 places a flag indicating that the stub (secondary) roll is active. Finally, operation 533 provides an indication (e.g., through an alert) that reassignment occurred.

If a sheet is not dispensed, then operation 535 checks the stored fuel gauge (amount remaining) of the stub (secondary) roll. If the fuel gauge (amount remaining) is greater than zero, operation 536 assumes that a jam, misfeed, error, or calculation error occurred. Such information may be indicated (e.g., through an alert). If the fuel gauge (amount remaining) is approximately equal to zero and the stub (secondary) roll is present (operation 537), then operation 538 indicates (e.g., through an alert) that the stub (secondary) roll is empty.

Returning to operation 506, if the roller cam does click (e.g., the roller senses movement of the primary roll), then operation 507 subtracts the expected dispensed sheet length from the stored fuel gauge (amount remaining) of the main (primary) roll. Operation 508 determines if a primary roll dispense occurred after service and, if so, then operation 540 indicates that the stub (secondary) roll was not used and operation 541 stores the fuel gauge (amount remaining) of the stub (secondary) roll as being equal to zero.

If the dispense was not after service, then operation 509 determines if the stub (secondary) roll level is greater than zero and, if so, then operation 545 indicates (e.g., through an alert) that double feed (e.g., double sheeting) is occurring.

Operation 510 determines if the fuel gauge (amount remaining) of the main (primary) roll is less than a reassignment level (i.e., for the ability to reassign the roll to become the secondary roll). If so, operation 550 indicates (e.g., through an alert) that the roll of sheet product that is currently the main (primary) roll is ready for reassignment Operation 511 determines if the fuel gauge (amount remaining) of the main (primary) roll is less than a predefined threshold level. If so, then operation 560 indicates (e.g., through an alert) a low fuel gauge (amount remaining) on the main (primary) roll. Then operation 561 determines if the paper is out (e.g., from the main (primary) roll). If so, then operation 562 indicates (e.g., through an alert) that the main (primary) roll is empty.

Finally, operation 512 returns to IDLE.

The method depicted in FIG. 12 and described above represents only one possible method for monitoring and operation of a sheet product dispenser. It is understood that the illustrated steps in FIG. 12 may be performed in any desired order and should not be limited to the illustrated embodiments. In some embodiments, certain ones of the steps described above may be modified, omitted, or further amplified. Furthermore, in some embodiments, additional optional steps may be included. Modifications, additions, omission, or amplifications to the steps above may be performed in any order and in any combination.

FIG. 12 illustrates an example flowchart of methods, systems and program products according to various embodiments of the present invention. It will be understood that each block or step of the flowchart, and combinations of blocks in the flowchart, can be implemented by computer program instructions. These computer program instructions may be loaded onto a computer, controller, or other programmable apparatus to produce a machine, such that the instructions which execute on the computer, controller, or other programmable apparatus create means for implementing the functions specified in the flowchart block(s) or step(s). These computer program instructions may also be stored in a computer-readable memory that can direct a computer, controller, or other programmable apparatus to function in a particular manner, such that the instructions stored in the computer-readable memory produce an article of manufacture including instruction means which implement the function specified in the flowchart block(s) or step(s). The computer program instructions may also be loaded onto a computer, controller, or other programmable apparatus to cause a series of operational steps to be performed on the computer, controller, or other programmable apparatus to produce a computer implemented process such that the instructions which execute on the computer, controller, or other programmable apparatus provide steps for implementing the functions specified in the flowchart block(s) or step(s).

Accordingly, blocks or steps of the flowchart support combinations of means for performing the specified functions, combinations of steps for performing the specified functions and program instruction means for performing the specified functions. It will also be understood that each block or step of the flowchart, and combinations of blocks or steps in the flowchart, can be implemented by special purpose hardware-based computer systems which perform the specified functions or steps, or combinations of special purpose hardware and computer instructions, such as through controller 200, 200'.

As indicated herein, some embodiments of the present invention may be utilized with other types of sheet product dispensers.

For example, FIGS. 13-14 illustrate an example single roll, automated sheet product dispenser 600 usable with some embodiments of the present invention. The sheet product dispenser 600 includes a partially transparent cover 630 and a backing 620. Additionally, the sheet product dispenser 600 includes an activation sensor 635 and a dispensing slot 625. The single roll of sheet product 650 is shown in FIG. 14. Notably, some embodiments of the present invention may monitor (e.g., with sensor 100, sensor 310, sensor 360, and/or sensor 390) the fuel gauge of the single roll of sheet product 650. In this regard, due to only being one roll of sheet product, some of the above noted functionality regarding multi-roll sheet product dispensers may not be applicable. Additionally, in some embodiments, the roller of the sensor may be removed for cost effectiveness or other reasons. Additional information regarding single roll automated sheet product dispensers, including components and functionality thereof, can be found in U.S. Pat. No. 7,984,872, which is assigned to the owner of the present invention and which is incorporated by reference in its entirety.

FIGS. 15, 15A, and 15B illustrate an example non-automated (mechanical) sheet product dispenser 700 usable with some embodiments of the present invention. The sheet product dispenser 700 includes a cover 730 and a backing 720. Additionally, the sheet product dispenser 700 includes a dispensing slot 725. To dispense, a user would pull on a portion of the sheet product 726 extending from the dispensing slot 725. The force generated by the user would enable dispensing of the portion of the sheet product, such as in conjunction with the pinch roller 728 in a known manner. In some embodiments, a cutting mechanism (e.g., a cutting knife) may be positioned within a roller of the roller assembly and configured to cut the portion of the sheet product during dispensing for use by the user. A primary roll of sheet product 750 may be held in a first position by a first roll holder 755 and a smaller secondary roll (not shown) may be positioned lower in the housing. Notably, some embodiments of the present invention may monitor (e.g., with sensor 100, sensor 310, sensor 360, and/or sensor 390) the fuel gauge of the primary roll of sheet product 750 (or secondary roll of sheet product). Such an example sheet product dispenser would be useful with the self-contained sensor that includes its own battery, controller, memory, and data communication device.

FIG. 16 illustrates another example non-automated (mechanical) sheet product dispenser 700' usable with some embodiments of the present invention. The sheet product dispenser 700' includes a cover 730'. Additionally, the sheet product dispenser 700' includes a dispensing slot 725'. To dispense, a user would pull on a portion of the sheet product 726' extending from the dispensing slot 725'. Though not shown, the sheet product dispenser 700' includes a single roll of sheet product. Notably, some embodiments of the present invention may monitor (e.g., with sensor 100, sensor 310, sensor 360, and/or sensor 390) the fuel gauge of the single roll of sheet product, such as described herein.

Additional information regarding non-automated (mechanical) sheet product dispensers, including components and functionality thereof, can be found in U.S. Pat. Nos. 7,270,292 and 5,441,189, both of which are assigned to the owner of the present invention and incorporated by reference in their entireties.

FIGS. 17, 18A, and 18B illustrate an example tissue dispenser 800, 800' usable with some embodiments of the present invention. In this regard, unless otherwise specified, tissue dispensers, such as the tissue dispensers shown in FIGS. 17, 18A, and 18B, are considered as example sheet product dispensers for embodiments described herein. The tissue dispenser 800, 800' includes a cover 830, 830' and a backing 820, 820' (shown in FIGS. 18A and 18B). One or more rolls of tissue 850 are stored in the tissue dispenser 800, 800', such as in cavity 851, 851' and/or cavity 852, 852'. To dispense, a user would pull on a portion of the tissue.

Notably, some embodiments of the present invention may monitor (e.g., with sensor 100, sensor 310, sensor 360, and/or sensor 390) the fuel gauge of at least one of the tissue rolls 850. For example, a first sensor 810, 810' is positioned in the first cavity 851, 851' and designed to monitor the first tissue roll. Likewise, a second sensor 811, 811' is positioned in the second cavity 852, 852' and designed to monitor a second tissue roll. Such an example sheet product dispenser may be useful with the described self-contained sensor that includes its own battery, controller, memory, and data communication device. In some embodiments, the roller of the sensor (e.g., sensors 810, 811) may be removed for cost effectiveness or other reasons.

As described herein, some embodiments of the present invention provide a sensor for monitoring fuel gauging in a sheet product dispenser. In this regard, embodiments of the present invention contemplate a method of manufacturing (or assembling) various sheet product dispensers with one or more sensors as described herein. For example, a sheet product dispenser may be provided and a sensor may be installed such that it interacts with at least one roll of sheet product (e.g., the primary roll), in accordance with embodiments of the present invention described herein.

As detailed herein, some embodiments of the present invention provide for use of the sensor (e.g., sensor 100, sensor 310, sensor 360, and/or sensor 390) or portions thereof in a single roll sheet product dispenser. In this regard, an example embodiment provides a sheet product dispenser comprising a housing and a roll holder positioned within the housing and configured to hold a roll of sheet product. The roll of sheet product defines an outer surface. The sheet product dispenser further comprises a dispensing mechanism positioned within the housing and configured to dispense a portion of sheet product from the roll of sheet product. The sheet product dispenser further comprises a sensor positioned within the housing and defining a first end and a second end. The sensor is rotatably attached to the housing proximate the first end around a pivot axis. The second end of the sensor is configured to contact the outer surface of the roll of sheet product and is configured to measure angular displacement of the sensor around the pivot axis to enable determination of an amount of sheet product remaining on the roll of sheet product. The sheet product dispenser further comprises a data communication device in communication with the sensor and configured to transmit measurement data associated with the measured angular displacement of the sensor.

In some embodiments, the sensor is configured to measure angular displacement of the second end of the sensor from prior to an instance of dispensing of the portion of the sheet product to after the instance of dispensing of the portion of the sheet product. Additionally or alternatively, the sensor is configured to rotate between at least a first position defined prior to an instance of dispensing of the portion of the sheet product and a second position defined prior to the instance of dispensing of the portion of the sheet product. As such, the sensor may be configured to measure the angular displacement of the sensor between the first position and the second position to enable determination of an amount of sheet product remaining on the roll of sheet product after the instance of dispensing of the portion of the sheet product.

In some embodiments, the sensor further comprises a roller positioned proximate the second end and configured to contact the outer surface of the roll of sheet product. The roller is configured to sense when the roll of sheet product rotates to dispense the portion of sheet product. Additionally, the data communication device may be configured to transmit a signal that contains the measurement data indicating both when the roll of sheet product rotates to dispense the portion of sheet product and the angular displacement of the sensor.

In some embodiments, the sensor comprises a battery. The battery and the data communication device may be attached to the sensor such that the sensor forms a single, self-powered unit that is configured to be utilized with a non-automated sheet product dispenser.

In some embodiments, the sheet product dispenser is non-automated such that force from a user exerted on a leading edge of the portion of sheet product enables dispensing of the portion of sheet product through the dispensing mechanism.

In some embodiments, the sheet product dispenser further comprises a controller in communication with the sensor and the data communication device, wherein the controller is configured to receive the measurement data and cause the data communication device to transmit the measurement data. Additionally, the controller may be configured to determine the amount of sheet product remaining on the roll of sheet product based on, at least, the received measurement data. Additionally, the controller may be configured to determine an alert to provide to a user associated with the determined amount of sheet product remaining on the roll of sheet product.

In some embodiments, the sheet product dispenser is automated such that the controller is further configured to control the dispensing mechanism to dispense the sheet product. Additionally, the controller may be configured to adjust a parameter of the dispensing mechanism based, at least, on the received measurement data.

Associated systems and methods (e.g., methods for manufacturing) are also contemplated by some embodiments of the present invention.

As detailed herein, some embodiments of the present invention provide for use of the sensor (e.g., sensor 100, sensor 310, sensor 360, and/or sensor 390) or portions thereof as a single unit that can be utilized in a sheet product dispenser (such as a non-automated sheet product dispenser). In this regard, an example embodiment provides an apparatus for sensing measurement data associated with an amount of sheet product remaining on a roll of sheet product in a sheet product dispenser. The apparatus comprises a paddle body defining a first end and a second end. The apparatus is configured to be rotatably attached to a housing of the sheet product dispenser around a pivot axis proximate the first end. The second end of the apparatus is configured to contact an outer surface of the roll of sheet product disposed within the sheet product dispenser. The apparatus further comprises a sensor configured to measure angular displacement of the second end around the pivot axis to enable determination of an amount of sheet product remaining on the roll of sheet product. The apparatus further comprises a data communication device in communication with the sensor and configured to transmit measurement data associated with the measured angular displacement of the sensor.

In some embodiments, the apparatus further comprises a battery. In such a regard, the apparatus forms a single, self-powered unit that is configured to be utilized with a non-automated sheet product dispenser.

In some embodiments, the sensor is configured to measure angular displacement of the second end of the apparatus from prior to an instance of dispensing of a portion of the sheet product from the sheet product dispenser to after the instance of dispensing of the portion of the sheet product from the sheet product dispenser.

In some embodiments, the sensor is configured to rotate between at least a first position defined prior to an instance of dispensing of a portion of the sheet product from the sheet product dispenser and a second position defined prior to the instance of dispensing of the portion of the sheet product from the sheet product dispenser. The sensor is configured to measure the angular displacement of the second end of the apparatus between the first position and the second position to enable determination of an amount of sheet product remaining on the roll of sheet product after the instance of dispensing of the portion of the sheet product.

In some embodiments, the apparatus further comprises a roller positioned proximate the second end and configured to contact the outer surface of the roll of sheet product. The roller is configured to sense when the roll of sheet product rotates to dispense the portion of sheet product. Additionally, the data communication device may be configured to transmit a signal that contains the measurement data indicating both when the roll of sheet product rotates to dispense the portion of sheet product and the angular displacement of the second end of the apparatus.

In some embodiments, the apparatus further comprises a controller in communication with the sensor and the data communication device.

Associated systems and methods (e.g., methods for manufacturing) are also contemplated by some embodiments of the present invention.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included herein. Although specific terms are employed herein, they are used in a generic and descriptive sense only and not for purposes of limitation.

The invention claimed is:

1. A sheet product dispenser comprising:

a housing;

a first roll holder positioned within the housing and configured to hold a first roll of sheet product, wherein the first roll of sheet product is assigned as a primary roll;

a second roll holder positioned within the housing and configured to hold a second roll of sheet product, wherein the second roll of sheet product is assigned as a secondary roll;

a dispensing mechanism positioned within the housing and configured to dispense a portion of sheet product from at least one of the first roll and the second roll; and a sensor positioned within the housing and configured to contact an outer surface of one of the primary roll or the secondary roll, wherein the sensor is configured to sense measurement data associated with the one of the primary roll or the secondary roll, wherein the sensor is configured to measure at least one of angular displacement of the sensor around a pivot axis connecting the sensor to the housing or linear displacement of a first portion of the sensor with respect to a second portion of the sensor to enable determination of an amount of sheet product remaining on at least the one of the primary roll or the secondary roll, wherein the sensor is further configured to sense when the one of the primary roll or the secondary roll rotates to dispense the portion of sheet product.

2. The sheet product dispenser of claim 1, wherein the sensor comprises:

a paddle body defining a first end and a second end, wherein the paddle body is pivotably attached to the housing proximate the first end around the pivot axis, wherein the paddle body is configured to measure a diameter of the one of the primary roll or the secondary roll based on an angle of movement around the pivot axis; and a roller positioned proximate the second end of the paddle body and configured to contact the outer surface of the one of the primary roll or the secondary roll, wherein the roller is configured to sense when the one of the primary roll or the secondary roll rotates to dispense the portion of sheet product.

3. The sheet product dispenser of claim 2, wherein the sensor comprises a battery and a data communication device, wherein the battery and the data communication device are attached to the paddle body such that the sensor forms a single, self-powered unit that is configured to be utilized with a non-automated sheet product dispenser.

4. The sheet product dispenser of claim 2, wherein the paddle body is flexible to maintain contact of the roller with the outer surface of the one of the primary roll or the secondary roll in an instance in which the one of the primary roll or the secondary roll defines a deformed shape.

5. The sheet product dispenser of claim 1, wherein the sensor comprises:

at least one arm defining a first end and a second end, wherein the first end of the at least one arm is attached to one of the housing or an axis of the primary roll or secondary roll, wherein the at least one arm is configured to measure a diameter of the one of the primary roll or the secondary roll based on an amount of linear movement of the first end with respect to the second end; and a roller positioned proximate the second end of the at least one arm and configured to contact the outer surface of the one of the primary roll or the secondary roll, wherein the roller is configured to sense when the one of the primary roll or the secondary roll rotates to dispense the portion of sheet product.

6. The sheet product dispenser of claim 1 further comprising a data communication device, wherein the data communication device is configured to transmit a signal that contains the measurement data indicating both when the one of the primary roll or the secondary roll rotates to dispense the portion of sheet product and the amount of sheet product remaining on the one of the primary roll or the secondary roll.

7. The sheet product dispenser of claim 1 further comprising a controller in communication with the sensor, wherein the sensor is configured to sense measurement data associated with the primary roll, wherein the controller is configured to determine the amount of sheet product remaining on the secondary roll based on, at least, the received measurement data corresponding to the primary roll.

8. The sheet product dispenser of claim 1 further comprising a controller in communication with the sensor, wherein the sensor is configured to sense measurement data associated with the primary roll, wherein, in an instance in which another roll of sheet product is positioned within the housing and assigned to be the primary roll, the controller is configured to determine if the first roll of sheet product was reassigned to become the secondary roll by:

determining an instance in which both sheet product is being dispensed and the primary roll is not rotating.

9. The sheet product dispenser of claim 1 further comprising a controller in communication with the sensor, wherein the sensor is configured to sense measurement data associated with the primary roll, wherein the controller is configured to determine whether the primary roll or the secondary roll is actively dispensing.

10. The sheet product dispenser of claim 1 further comprising a controller in communication with the sensor, wherein the sensor is configured to sense measurement data associated with the primary roll, wherein the controller is configured to determine an instance in which both the primary roll and the secondary roll are actively dispensing by:

determining an instance in which the first roll of sheet product was reassigned to become the secondary roll; and determining an instance in which the primary roll of sheet product is actively dispensing and the amount of sheet product remaining on the secondary roll is greater than zero.

11. The sheet product dispenser of claim 1 further comprising a controller in communication with the sensor, wherein the sensor is configured to sense measurement data associated with the primary roll, wherein the controller is configured to determine an alert to provide to a user, wherein the alert is associated with at least one of:

an amount of sheet product remaining on the primary roll;

an amount of sheet product remaining on the secondary roll;

a condition of the primary roll indicating that the first roll of sheet product may be reassigned to become the secondary roll;

whether the first roll of sheet product was successfully reassigned to become the secondary roll;

whether the primary roll or the secondary roll is actively dispensing; or an instance in which both the primary roll and the secondary roll are actively dispensing.

12. The sheet product dispenser of claim 1 further comprising a controller in communication with the sensor, wherein the sensor is configured to sense measurement data associated with the primary roll, wherein the controller is configured to determine an alert to provide to a user, wherein the alert is determined in response to at least one of:

determining if the first roll of sheet product was reassigned to become the secondary roll; or determining an instance in which both the primary roll and the secondary roll are actively dispensing.

13. The sheet product dispenser of claim 1 further comprising a controller in communication with the sensor, wherein the controller is further configured to control the dispensing mechanism to dispense the sheet product, wherein the controller is configured to adjust a parameter of the dispensing mechanism based, at least, on the received measurement data.

14. The sheet product dispenser of claim 1, wherein the sensor is configured to apply a smoothing filter to received measurement data to account for a deformed shaped of the primary roll.

15. A system for monitoring usage of sheet product, the system comprising:

a sheet product dispenser comprising:

a housing;

a first roll holder positioned within the housing and configured to hold a first roll of sheet product, wherein the first roll of sheet product is assigned as a primary roll;

a second roll holder positioned within the housing and configured to hold a second roll of sheet product, wherein the second roll of sheet product is assigned as a secondary roll;

a dispensing mechanism positioned within the housing and configured to dispense a portion of sheet product from at least one of the first roll and the second roll; and a sensor positioned within the housing and configured to contact an outer surface of one of the primary roll or the secondary roll, wherein the sensor is configured to sense measurement data associated with the one of the primary roll or the secondary roll, wherein the sensor is configured to measure at least one of angular displacement of the sensor around a pivot axis connecting the sensor to the housing or linear displacement of a first portion of the sensor with respect to a second portion of the sensor to enable determination of an amount of sheet product remaining on at least the one of the primary roll or the secondary roll, wherein the sensor is further configured to sense when the one of the primary roll or the secondary roll rotates to dispense the portion of sheet product.

16. The system of claim 15, wherein the sensor comprises:

a paddle body defining a first end and a second end, wherein the paddle body is pivotably attached to the housing proximate the first end around the pivot axis, wherein the paddle body is configured to measure a diameter of the one of the primary roll or the secondary roll based on an angle of movement around the pivot axis; and a roller positioned proximate the second end of the paddle body and configured to contact the outer surface of the one of the primary roll or the secondary roll, wherein the roller is configured to sense when the one of the primary roll or the secondary roll rotates to dispense the portion of sheet product.

17. The system of claim 15, wherein the sensor comprises:

at least one arm defining a first end and a second end, wherein the first end of the at least one arm is attached to one of the housing or an axis of the primary roll or secondary roll, wherein the at least one aim is configured to measure a diameter of the one of the primary roll or the secondary roll based on an amount of linear movement of the first end with respect to the second end; and a roller positioned proximate the second end of the at least one arm and configured to contact the outer surface of the one of the primary roll or the secondary roll, wherein the roller is configured to sense when the one of the primary roll or the secondary roll rotates to dispense the portion of sheet product.

18. The system of claim 15 further comprising a data communication device, wherein the data communication device is configured to transmit a signal that contains the measurement data indicating both when the one of the primary roll or the secondary roll rotates to dispense the portion of sheet product and the amount of sheet product remaining on the one of the primary roll or the secondary roll.

19. An apparatus for sensing measurement data associated with an amount of sheet product remaining on a roll of sheet product in a sheet product dispenser, wherein the apparatus comprises:

a paddle body defining a first end and a second end, wherein the apparatus is configured to be pivotably attached to a housing of the sheet product dispenser around a pivot axis proximate the first end, wherein the second end of the apparatus is configured to contact an outer surface of the roll of sheet product disposed within the sheet product dispenser;

a sensor configured to measure angular displacement of the second end around the pivot axis to enable determination of the amount of sheet product remaining on the roll of sheet product;

a roller positioned proximate the second end and configured to contact the outer surface of the roll of sheet product, wherein the roller is configured to sense when the roll of sheet product rotates to dispense the portion of sheet product; and a data communication device in communication with the sensor and configured to transmit measurement data associated with the measured angular displacement of the sensor.

20. The apparatus of claim 19 further comprising a battery, wherein the apparatus forms a single, self-powered unit that is configured to be utilized with a non-automated sheet product dispenser.

21. The apparatus of claim 19, wherein the sensor is configured to pivot between at least a first position defined prior to an instance of dispensing of a portion of the sheet product from the sheet product dispenser and a second position defined prior to the instance of dispensing of the portion of the sheet product from the sheet product dispenser, wherein the sensor is configured to measure the angular displacement of the second end of the apparatus between the first position and the second position to enable determination of the amount of sheet product remaining on the roll of sheet product after the instance of dispensing of the portion of the sheet product.

22. The apparatus of claim 19, wherein the data communication device is configured to transmit a signal that contains the measurement data indicating both when the roll of sheet product rotates to dispense the portion of sheet product and the angular displacement of the second end of the apparatus.

* * * * *